United States Patent [19]

Mierzwinski

[11] Patent Number: 5,005,123

[45] Date of Patent: Apr. 2, 1991

[54] CONTROL SYSTEM FOR MICROWAVE COOKING APPLIANCE

[75] Inventor: Eugene P. Mierzwinski, Ft. Wayne, Ind.

[73] Assignee: Hamilton Standard Controls, Inc., Farmington, Conn.

[21] Appl. No.: 799,715

[22] Filed: Nov. 19, 1985

[51] Int. Cl.[5] ..... H05B 9/06

[52] U.S. Cl. ..... 364/400; 219/10.55 B

[58] Field of Search ..... 364/400; 219/10.55 B, 219/506

[56] References Cited

U.S. PATENT DOCUMENTS

| | | | |
|---|---|---|---|
| 4,295,027 | 10/1981 | Zushi et al. | 49/506 |
| 4,383,156 | 5/1983 | Furisawa | 219/10.55 B |
| 4,399,352 | 8/1983 | Ueda | 219/10.55 B |
| 4,425,490 | 1/1984 | Takeda et al. | 219/10.55 B |
| 4,431,893 | 2/1984 | Levie | 219/10.55 B |
| 4,481,398 | 11/1984 | Ueda | 219/10.55 B |
| 4,539,453 | 9/1985 | Miyazaki et al. | 219/10.55 B |
| 4,604,518 | 8/1986 | Payne | 219/506 |

*Primary Examiner*—Jerry Smith
*Assistant Examiner*—Kim Thanh Tbui

[57] ABSTRACT

A control system for a microwave oven includes a magnetron power circuit, an electronic controller, and input control circuitry. The control system is adapted to be connected to a source of electrical power, typically an AC line supply. The line supply may be converted to DC for powering the electronic controller, however, the input control circuitry is structured to prevent connection of the power supply to the electronic controller until an intentional manual action occurs. This prevents the electronic controller from responding to noise or the like to become unintentionally powered and thus possibly operate in an undesired state. The input control circuitry includes switches associated with data input keys for temporarily connecting power to the controller when actuated. Such actuation of a data key enables the system to be powered-up and also to enter data.

12 Claims, 21 Drawing Sheets

TO K8
TO K1
TO RESET
-9v.
NEUTRAL
L1
F1
F2
VUNREG

CONTROL SYSTEM FOR MICROWAVE COOKING APPLIANCE

CROSS-REFERENCE TO RELATED PATENT APPLICATIONS

This application is related to the subject matter disclosed and claimed in Utility Application U.S. Ser. No. 06/799,716, now U.S. Pat. No. 4,725,948 for HEATING APPLIANCE CONTROL SYSTEM by Eugene P. Mierzwinski and Design Application U.S. Ser. No. 06/806,169, now U.S. Pat. No. D295,252 for TOUCH CONTROL PANEL FOR A MICROWAVE OVEN by Eugene P. Mierzwinski, both applications filed on even date herewith and assigned to the same assignee.

1. Technical Field

The present invention relates generally to a control system for a microwave cooking appliance, such as a microwave oven, and more particularly to an improved control system for reliable and convenient operation of the heating appliance.

2. Background Art

Certain cooking appliances, and particularly microwave ovens, have recently employed stored program-type controllers such as microprocessors or microcomputers for controlling many of their operating functions. There has arisen, however, a concern that a nonintended situation may be created by some phenomenon beyond the user's control. One phenomenon most often considered is that of noise-related malfunctions arising from power surges, radiated electromagnetic interference or the like. In such instance, the microcomputer may be placed in an unintended mode which either effects a heating operation which is undesired or conversely, fails to provide heat when it is desired. The former situation may give rise to the greater concern because of the possibility of generating thermal and/or radiant energy under unintended circumstances.

Several patents which are illustrative of various types of devices and techniques employed for minimizing erroneous operation of a microwave oven include U.S. Pat. Nos. 4,011,428; 4,367,387; 4,431,893; 4,481,393 and 4,533,810. One means common to all of these patents is the inclusion of a door interlock switch which prevents operation of the magnetron while the oven door is open. However, various ones of the patents also disclose other techniques for minimizing or preventing erroneous operation.

For instance, U.S. Pat. No. 4,367,387 discloses the use of non-conventional optical isolation circuitry for delivering control signals from the microcomputer controller to the magnetron power circuitry. Moreover, that patent requires that two separate outputs of the microcomputer be cooperatively enabled to thereby enable the photocoupler circuit.

In U.S. Pat. No. 4,481,393 there is disclosed a sequential arrangement for applying power to the magnetron which is self-checking and which serves to stop the entire heating operation if an improper condition is sensed.

With the possible exception of U.S. Pat. No. 4,431,893, the controllers associated with the respective magnetron power circuits in each of the aforementioned patents appear to be continuously powered so long as the system is connected to a source of AC line voltage, as typically occurs when the appliance is plugged into a conventional AC outlet and conventional included circuitry converts the AC line voltage to an appropriate DC level which is applied to the appropriate inputs of the microcomputer controller. However, with electrical power being applied to the controller upon connection of the appliance with the line supply, there continues to exist the possibility of erroneous activation of the microcomputer in an unplanned mode due to some source of noise or internal anomaly.

U.S. Pat. No. 4,431,893 describes a microwave oven timer having not only the conventional door interlock switches, but also some provision for controlling the application of energizing power to the controller even after the appliance is connected to the line supply voltage. Specifically, it appears that a secondary winding of the isolation transformer provides a 22 volt supply to the controller, and energization of the primary of that isolation transformer is controlled via a pair of door interlock switches and a relay contact. From an intially dormant condition, the isolation transformer, and thus the control circuitry itself, may be energized only by the action of opening or closing the oven door. Following initial energization of the controller, a hold relay serves to maintain it energized until a short time after completion of a cooking operation. It is not clear whether power is fully removed from the controller following completion of a cooking operation. This is because of the apparent desire to maintain the associated memory energized, preferably via power derived from the line supply as opposed to a standby battery. The microwave oven of that patent is characteristically used in commercial environments, such as a fast food facility. A set of 10 preset times are preprogrammed into the controller and stored there between successive operations. Actuation of each of the 10 input switches or buttons is effective to call forth a respective one of the preset times for controlling the cooking operation. These preset times are normally not alterable by the casual user of the microwave oven, but may be reprogrammed by an owner having limited access to the system. Upon completion of the cooking cycle selected or if no cycle has been selected within a short interval after the oven door is closed, a shutdown signal serves to remove power from the controller.

It will be appreciated that while the system of U.S. Pat. No. 4,431,893 appears to withold power from the controller during periods of dormancy, certain inconveniences may result. Specifically, because actuation of the oven door is required to apply power to the controller, a delay of more than 60 seconds between the closing of the oven door and the actuating of one of the 10 preset time buttons will prevent the subsequent actuation of one of those buttons from beginning the cooking and timing cycle. It will then be necessary to reopen and close the door and then depress one of the 10 input switches within the 60 second interval in order to begin operation.

Accordingly, it is a principal object of the present invention to provide an improved control system for a cooking appliance, and particularly a microwave oven, having both enhanced safety characteristics and relative ease of operation. Included within this object is the provision of a control system which witholds electrical power from the appliance controller despite connection of the appliance to an AC line supply, until the occurrence of an convenient user-initiated action.

SUMMARY OF THE INVENTION

In accordance with the invention there is provided an improved apparatus for the control of a heating appliance, such as a microwave oven or the like. The control apparatus includes a microwave power circuit with a microwave generator, a source of electrical power for at least the microwave power circuit and control means for controlling at least the microwave power circuit. The control means generally comprises an electrically-energized electronic controller for operating in accordance with data programmed therein and input control circuitry connected to the electrical power source and to the electronic controller for controlling the application of electrical energizing power to and the entry of programming data into the electronic controller. The electronic controller is operatively connected to the microwave power circuit for controlling application of the electrical power to the microwave power circuit. The input control circuitry includes at least a data entry key for controlling the programming of data into the electronic controller. That input control circuitry is further operative in response to an initial actuation of the data entry key for applying startup energizing power to the electronic controller.

The input control circuitry includes a preliminary supply circuit and a main supply circuit between the source of electrical power and the electronic controller. The preliminary supply circuit is completed by the initial actuation of the data entry key and the main supply circuit is completed only following the completion of the preliminary supply circuit. The main supply circuit includes a normally-open, signal-responsive power switch in series therewith, and the power switch is actuated to its closed position by a latching signal from the electronic controller. The electronic controller is responsive to the initial actuation of the data entry key for providing the latching signal. The preliminary supply circuit includes a normally-open, power-up switch in series therewith. The input control circuitry includes a manually-actuatable data entry switch operatively connected to the electronic controller for controlling the programming of the data thereinto when actuated. The data entry key, the power-up switch and the data entry switch are so structured and positioned that actuation of the data entry key is operative both to close the power-up switch and to actuate the data entry switch. In the preferred embodiment, there are multiple data entry keys and a corresponding number of both the data entry switches and the power-up switches, whereby initial actuation of any one of the of the data entry keys is operative to apply start-up energizing power to the electronic controller.

The electronic controller is responsive to certain data received for providing timing and power level control functions, and each of the data entry keys is operative, when actuated, to enter the certain data into the electronic controller. The signal-responsive switch in the main supply circuit is a power relay having a pair of normally-open contacts which are closed while the relay receives the latching signal. The power relay also includes a second pair of normally-open contacts and the microwave power circuit includes the second pair of normally-open contacts in series therewith whereby the microwave generator is capable of receiving electrical power from the source only while the power relay receives the latching signal. The latching signal from the electronic controller is terminated upon completion of a timing function thereby to open the main supply circuit and remove energizing power from the electronic controller.

The electronic controller includes a prestored program which is responsive to the initial actuation of one of the data entry keys for starting a power-down timer which is preset to a predetermined interval representing the maximum allowable interval before the next subsequent actuation of any one of the data entry keys. The latching signal to the power relay is terminated to remove energizing power from the electronic controller if the power-down timer times out prior to any next subsequent actuation of one of the data entry keys. The electronic controller is further responsive to the entry of data via the selective actuation of the data entry keys for defining an operating program therein; input control circuitry further includes at least one function key operatively connected to the electronic controller which is actuatable for initiating the execution of the operating program following its definition; and the electronic controller further includes power-down timing means which is preset to a predetermined timing interval, is started by the actuation of any one of the data entry keys, and which times out only if neither one of the data entry keys nor the function is actuated during the predetermined timing interval, and wherein the timing out of the power-down timing means is operative to terminate the latching signal to the power switch.

BEST MODE FOR CARRYING OUT THE INVENTION

Figure 1:
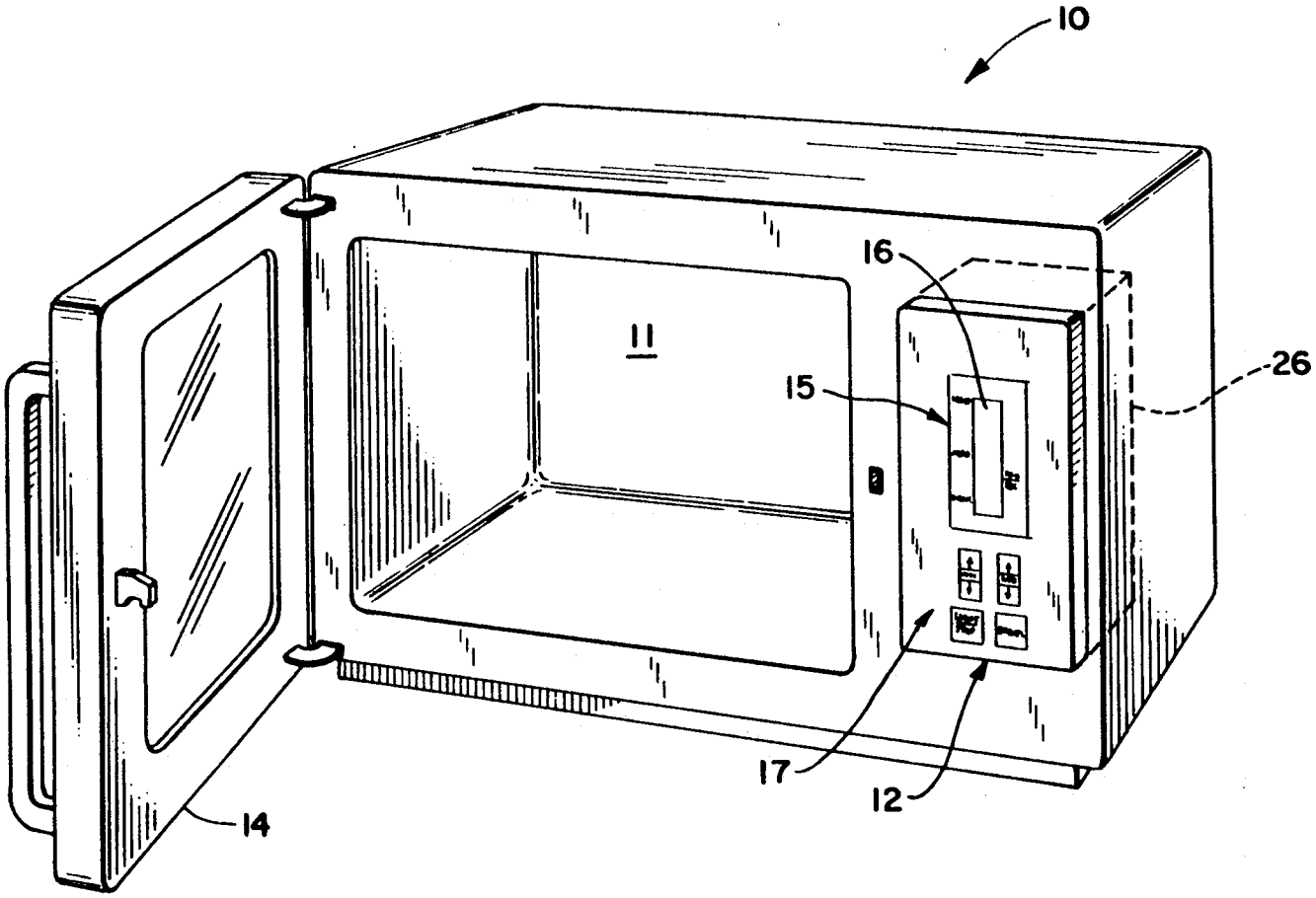
FIG. 1 is a perspective view of a microwave oven incorporating a control in accordance with the invention.

Although the following detailed description pertains specifically to a microwave oven, it will be appreciated that the invention is similarly applicable to other types of heat cooking appliances. Referring to FIG. 1, there is illustrated a perspective view of a microwave oven 10 embodying the invention. The microwave oven 10 has a main body comprising a cooking chamber 11 and a control panel 12. The main body of the microwave oven has a door 14 provided to enclose an opening of the cooking chamber 11 and openable to provide access thereto. The control panel 12 includes a display portion 15 and an operating portion or keyboard 17. The display portion 15 includes a display 16 and the operating portion 17 includes a keyboard or key panel having a POWER incrementing key 20 and a POWER decrementing key 21, a TIME incrementing key 22 and a TIME decrementing key 23, a START/STOP key 24 and a CANCEL key 25. The display 16 provides a graphic indication of a power setting and of the time remaining, within preselected time increments, for a timed function such as cooking. The operating portion 17 provides the several data and functional inputs to the control circuitry associated with the oven 10 and generally represented by the dotted block 26 positioned behind the display panel in FIG. 1. Most of the control circuitry directly incorporated in the package represented by the dotted block 26 is concerned with the programming of operation of the oven's magnetron. The magnetron 28, seen in FIG. 3, and its associated power circuitry are typically separate within oven 10 from the control circuitry contained within the control package 26 represented by broken line in FIG. 1. The control panel 12 and its associated control circuitry 26 will be described in more detail subsequently.

Figure 3:
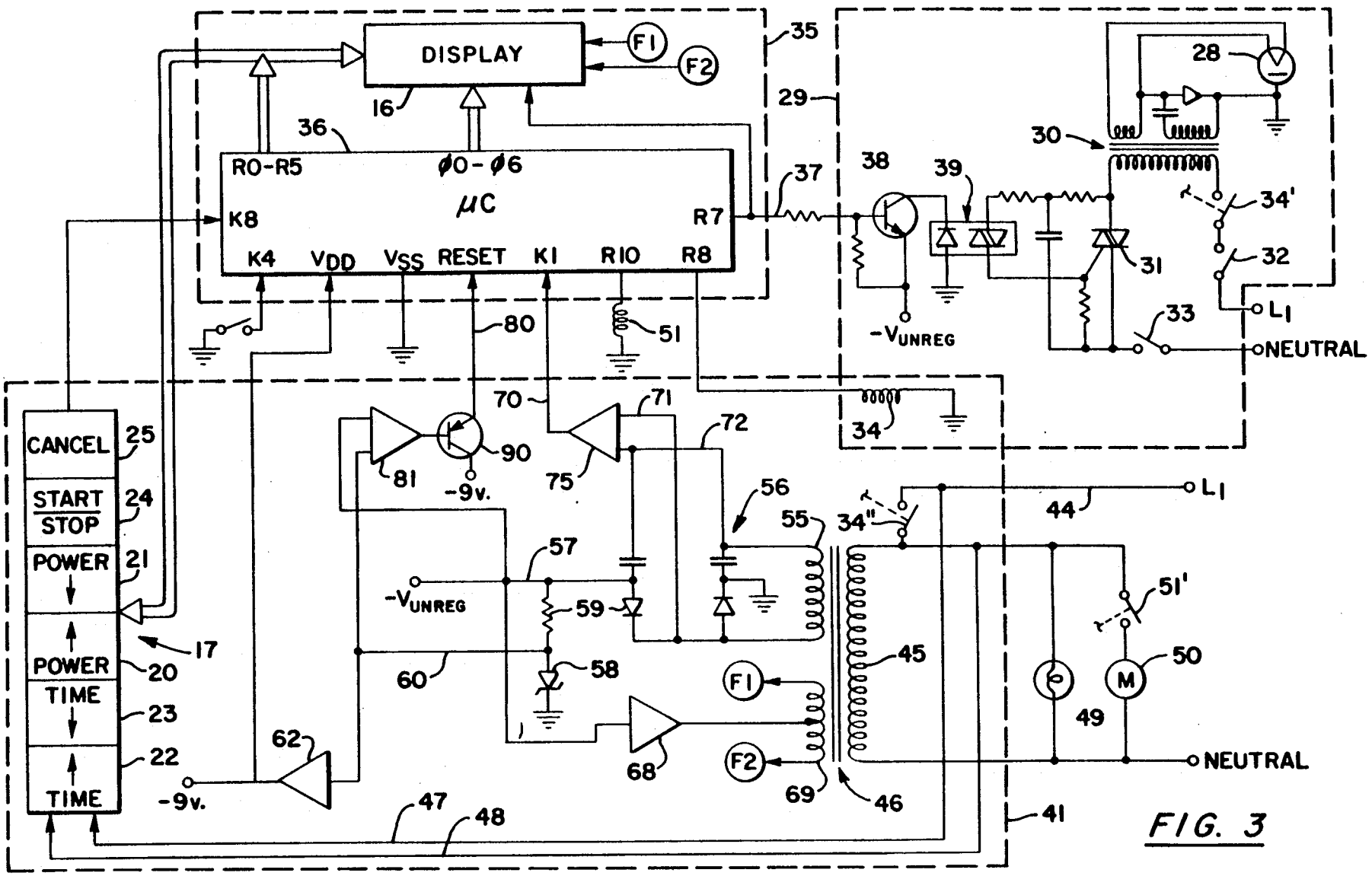
FIG. 3 is a generalized block diagram of the control system.

Referring to FIG. 3, the magnetron 28 is included as part of a microwave power circuit, generally represented by the enclosed broken line portion 29. The magnetron 28 is powered by a conventional AC line supply voltage represented by terminals L1 and Neutral. The magnetron 28 is connected in a conventional manner in the secondary circuit of transformer 30 having its primary controllably connected between the power terminals L1 and Neutral. The control of power flow through the primary of transformer 30 is controlled by a semiconductor switch, such as triac 31, and additionally by the closure of several normally-open air gap switches including door interlock switch contacts 32 and 33 and a relay contact 34' of relay 34 to be described in greater detail. The door interlock switches 32 and 33 are actuated to their closed positions and remain thereat only while the door 14 of oven 10 is closed. Relay contact 34' will be closed and remain closed only if an appropriate power-up operation occurs.

Electronic control circuitry, generally represented by dotted line 35 in FIG. 3 and specifically including a microcomputer 36, is operative to provide a magnetron-enabling signal appearing at output port R7 of the microcomputer 36. The signal appearing at port R7 is determined in a known manner such that it begins at a predetermined phase angle within a line cycle, typically 90°, to trigger magnetron conduction at that phase angle. That signal is extended, via lead 37 and a signal buffer 38, to an optical isolator 39. The isolator 39 serves to connect the magnetron-enabling signal to the gate circuit of the triac 31 in a manner providing electrical isolation between the microcomputer 36 and the majority of the magnetron drive circuitry. The output of the optical isolator 39 is connected in the gate circuit of triac 31 and operates to turn on the magnetron. Suitably-scaled RC components in the gate and anode circuits of triac 31 serve to control in-rush current.

The microcomputer 36, for example a TI model TMS-1070, is appropriately programmed, as will be hereinafter described, to control the magnetron drive circuitry 29, the display 16, and to respond to inputs from the keyboard 17. In accordance with an aspect of the invention, the keyboard 17 and its associated keys 20–25 are included as part of input control circuitry, contained within broken line box 41, for controlling various inputs to the microcomputer 36. The display 16 is of the vacuum-fluorescent type, and requires a DC-biased, AC supply at inputs F1 and F2 to the cathode heater and a source of DC potential, $-V_{unreg}$, for the anode circuitry. The power supply requirements of the microcomputer 36 typically include connecting input $V_{SS}$ to ground and providing a −9 volt regulated DC voltage to the input $V_{DD}$. The AC supply and the $-V_{unreg}$ DC supply for display 16, and the regulated −9 volt supply for microcomputer 36, are derived in the input control circuitry 41 from a conventional AC supply source, as represented by a parallel set of line terminals, also designated L1 and Neutral. The terminal L1 is connected, via lead 44 and a relay contact 34', to one end of the primary coil 45 of a transformer 46. The other end of transformer primary 45 is connected to the Neutral terminal of the line voltage supply. The relay contacts 34" are of the normally-open type and are closed only when the relay 34 is energized by an appropriate control signal from the microcomputer 36, as will be hereinafter described.

A preliminary supply circuit is connected in parallel with the relay contact 34" for controllably bypassing that open contact 34" in response to a manual input action. The preliminary supply circuit includes one or more manually-actuated, parallel-connected, normally-open switches associated with the keyboard 17 and connected across the relay contact 34" by a pair of leads 47 and 48. Specifically, referring to FIG. 4A, four manually-actuated momentary switches 20*a*, 21*a*, 22*a* and 23*a* are connected in parallel across leads 47 and 48 and thus across relay contact 34". Each of the aforementioned momentary action switches 20*a*–23*a* is associated with a respective one of the key pads 20–23. Independently of the input control circuitry 41, a lamp 49 and a fan motor 50 are each connected in parallel across the opposite ends of the primary 45 of transformer 46. The motor 50 is connected in series with a normally-open relay contact 51' of a relay 51 connected to the R10 output of the microcomputer 36. Lamp 49 illuminates the cooking cavity 11 of the oven 10 when power is applied across the ends of the primary 45 of transformer 46. A fan or stirrer, driven by motor 50, changes the mode patterns in the oven 10 in a known manner and is energized when power is applied across the primary coil 45 of transformer 46 and the relay 51 is energized to close its contact 51'.

Figure 4A:
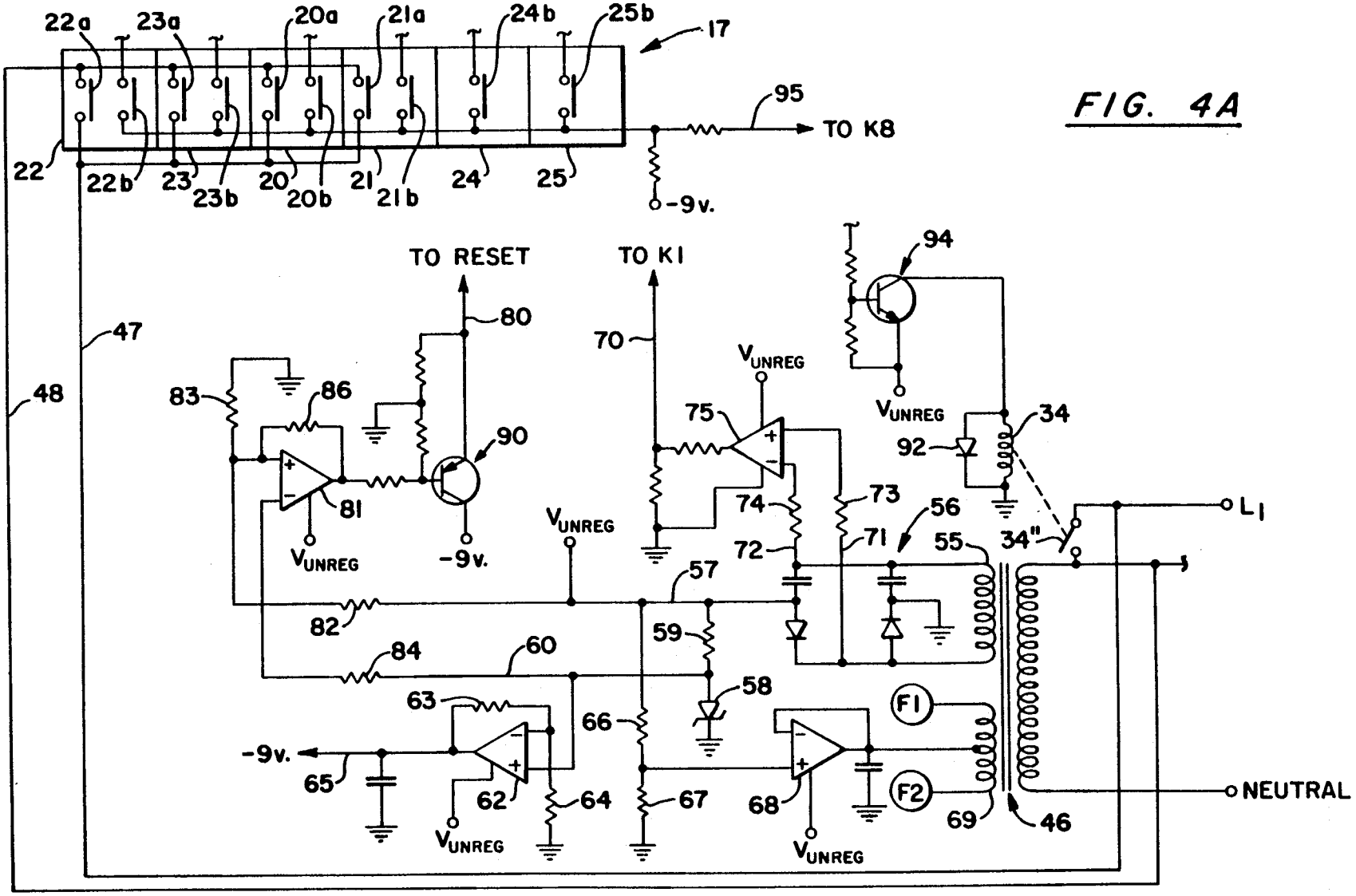
FIGS. 4A and 4B are detailed schematic diagrams of the control depicted in FIG. 3.

Referring further to FIG. 3 and to FIG. 4A for greater detail, a secondary coil 55 of transformer 46 is connected to a voltage doubler circuit 56 from which is derived, on lead 57, an unregulated supply voltage, $V_{unreg}$, of −29 volts DC. A 6.2 volt zener diode 58 is connected from ground to the source of $V_{unreg}$ 57 via a voltage dropping resistor 59. The −6.2 volt potential of zener 58 appears on conductor 60 which is extended to the positive input of a linear amplifier 62. A scaling network comprised of resistors 63 and 64 is connected between the output of amplifier 62, the negative input of that amplifier and ground for maintaining a regulated −9 volt supply signal at the output 65 thereof so long as the positive input remains at approximately −6.2 volts.

The unregulated voltage on lead 57 is extended, via a voltage divider comprised of resistors 66 and 67, to the positive input of a linear amplifier 68. The output of amplifier 68 is connected back to its negative input and to a center tap on a second secondary coil 69 of the transformer 46. The voltage at the output of amplifier 68 is typically about −24.2 volts such that the AC voltage between F1 and F2 at the opposite ends of the transformer secondary 69 varies about −24 volts to serve as the DC-biased, AC supply to the cathode heaters of the vacuum fluorescent display element 16.

A line sync signal is applied to the K1 input of microcomputer 36 via lead 70 for synchronizing various control operations with the frequency and/or phase of the line supply. One such operation includes phasing the control of conduction of magnetron 28 to a desired angle in the line cycle. The line sync signal on lead 70 is provided by extending a pair of leads 71 and 72 from the respective opposite ends of the transformer secondary 55 and through respective resistors 73 and 74 to respective positive and negative inputs of a comparator 75. One of the signal voltages on leads 71 and 72 serves as the reference for the other such that when the other exceeds the reference by more than 20 millivolts, the comparator changes state and thereby causes a square-wave shaped output from the comparator 75 of a magnitude appropriate for use as the line sync signal to microcomputer 36.

A RESET input of the microcomputer 36 receives an appropriate control signal via lead 80 connected thereto. The RESET input of microcomputer 36 is responsive to a logic input at ground potential for inhibiting all operation of the microcomputer and to a logic input at the −9 volt level for resetting or initializing conditions in the microcomputer as a first step in beginning a control routine. A condition in which the line supply power is either disconnected or falls below a critical threshold results in the production of a lock-up signal at ground level and conversely, the application or restoration of line supply power above a critical threshold results in the generation of a RESET or initializing signal at −9 volts. Specifically, $V_{unreg}$ is applied to the positive input of a comparator 81 via a voltage divider comprised of resistors 82 and 83. Similarly, the voltage appearing at the junction between resistor 59 and zener 58 is extended through a signal-limiting resistor 84 to the negative input of comparator 81. Accordingly, the output of comparator 81, which is connected to the positive input via a resistor 86, is typically at either −29 volts or substantially at ground, depending upon whether the unregulated voltage, $V_{unreg}$, is negatively greater than or less than the relatively stable reference voltage appearing at the negative input. Assuming $V_{unreg}$ is in the range of −29 volts, as is the normal steady-state case, the output of comparator 81 will be at approximately −29 volts. On the other hand, if the line supply has been disconnected or is unusually low, such that the unregulated voltage is no greater than the voltage appearing at the negative input of comparator 81, its output will be substantially at ground. The output from comparator 81 is shifted in level by transistor 90 and associated biasing and load resistors such that the voltage swing is only between ground and −9 volts. Another part of the input control circuitry within dotted block 41 of FIG. 3 includes the relay 34 and its associated suppression diode which is controlled, via a driver transistor 94, by the R8 output of microcomputer 36. Energization of relay 34 serves to actuate contact 34' of the magnetron power supply circuit 29 and contact 34'' of the input control circuit to their respective closed positions. It is for this reason that the dotted blocks 29 and 41, respectively defining the magnetron power circuitry and the input control circuitry have been overlapped to include the relay coil 34.

Referring to a final portion of the input control circuitry 41 depicted in FIG. 4A, each of the key pads 20–25 of the key panel 17 includes a respective manually-actuated momentary switch **20*b*–25*b* for providing a corresponding input via lead 95 to input port K8 of microcomputer 36. It will be appreciated that each of the six key pads 20–25 includes a respective momentary switch 20*b*–25*b*, whereas only the data input key pads 20–23 further include respective momentary switches 20*a*–23*a*. Manual actuation of each of the key pads 20–23 results in corresponding actuation of both the "a" and "b" switches associated with the respective key pad. Such arrangement serves the dual function of providing a bypass path about the relay contact 34''** and of providing the input of respective data when a selected data key pad is actuated.

Figure 4B:
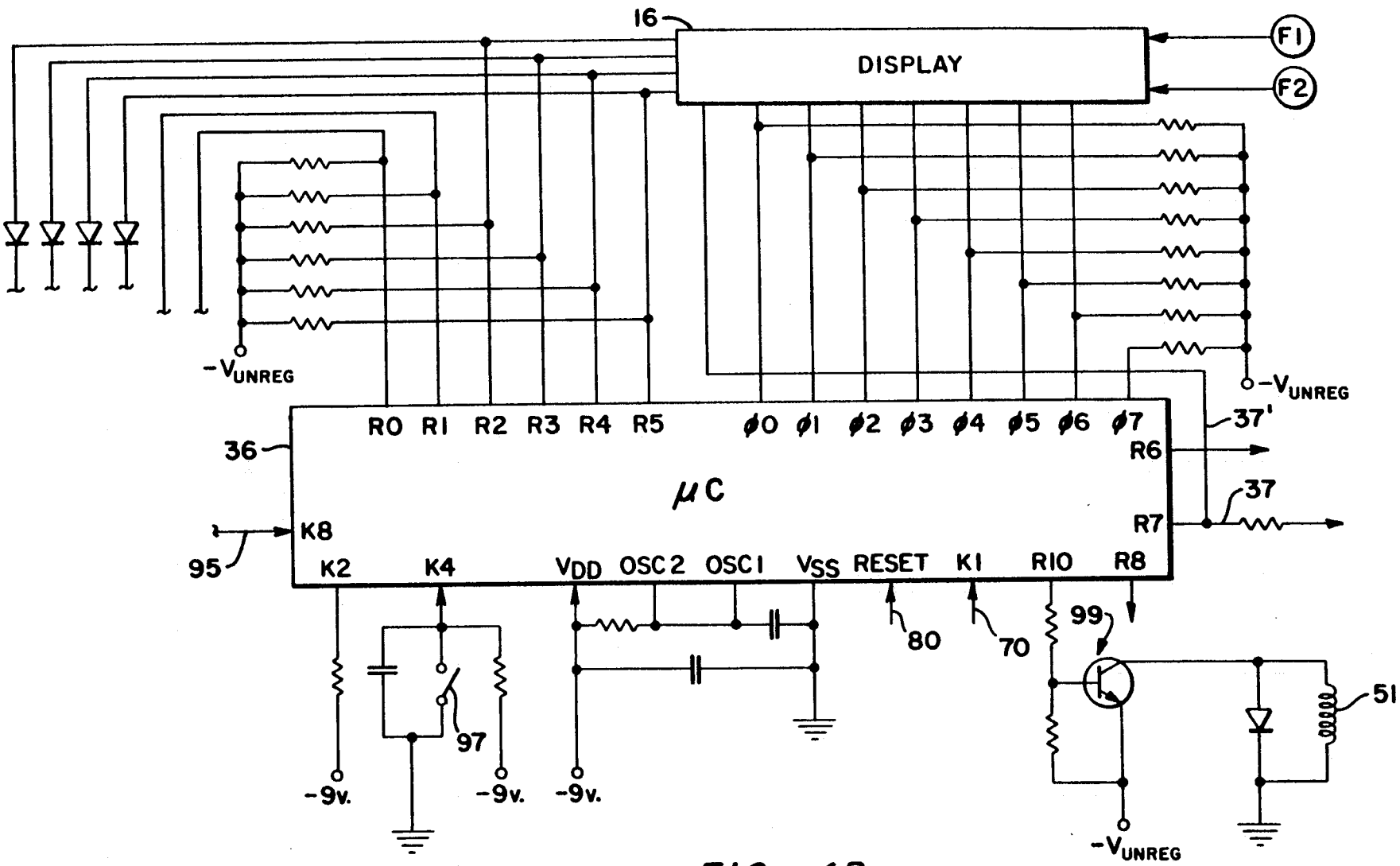

Referring to the electronic controller portion 35 of FIG. 3 as set forth in greater detail in FIG. 4B, the microcomputer 36 is seen to have several additional inputs and outputs beyond those previously mentioned. Depending upon whether the line supply is 50 Hz or 60 Hz, input K2 is connected either to ground or to −9 volts, respectively. A door switch 97 is connected to input port K4 to provide an indication to the microcomputer of whether the door 14 is open or closed, the open condition being represented by the normally-open position of switch 97. The relay 51 includes an associated suppression diode 98 which is controlled, via driver transistor 99, by the output port R10. Energization of relay 51 closes the normally-open contact 51' to permit energization of the fan motor 50. Microcomputer output R7, in addition to providing the magnetron control signal on line 37, additionally extends that signal via lead 37' to a terminal of the display 16 to serve as an indication of magnetron energization. The microcomputer output R6 may be used to provide a signal to an optional loudspeaker for audibly signifying end of cooking cycle (EOC).

Figure 2:
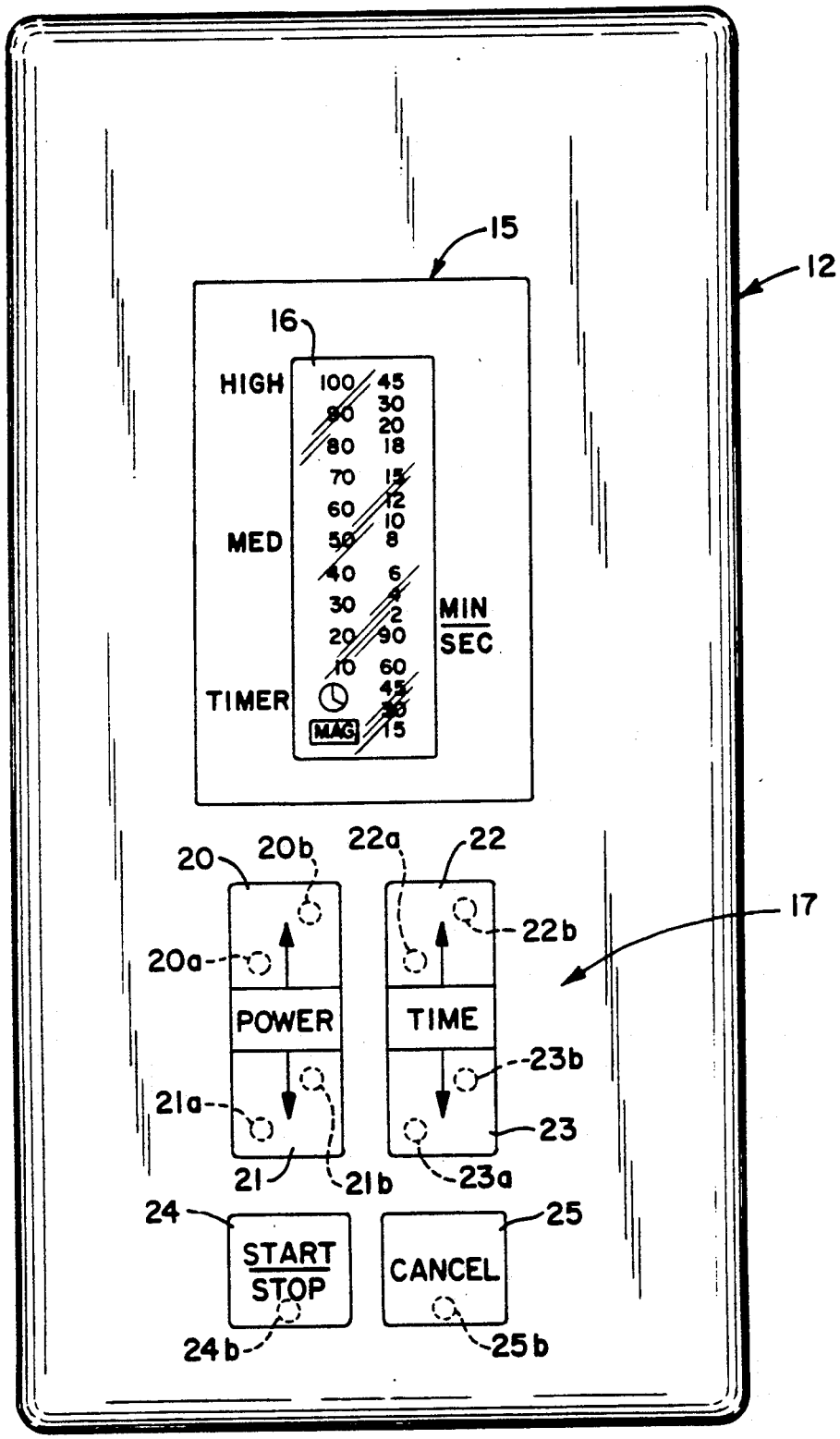
FIG. 2 is an enlarged view of the front panel of the control of the invention.

In accordance with an aspect of the invention and referring again also to FIG. 2, the display 16 is vertically oriented to present two vertical columns of control data, the righthand column containing time data and the lefthand column containing principally power data. The lefthand column also includes an indication of operation in a timing mode and an indication of magnetron energization. The various indicia are incorporated in the vaccum tube fluorescent display device 16 itself and are actively displayed when appropriate portions of the fluorescent display device are energized. The righthand column contains 16 indicia each representative of and directly indicating, a specific time value. These time values are incremented from bottom to top and represent successive discrete timing intervals. In the illustrated embodiment, those values include 15, 30, 45, 60 and 90 seconds and 2, 4, 6, 8, 10, 12, 15, 18, 20, 30, and 45 minutes. It will be appreciated that each time interval value differs from the others by at least 10% and typically, 20% or more. These time intervals have been selected to substantially coincide with all or nearly all cooking times associated with microwave cooking recipes. It will be understood that other values might also be selected without departing from the invention.

The lefthand column of display 16 includes 12 indicia, with the lowermost indicium, MAG, being indicative of magnetron energization and tied directly to lead 37' from the microcomputer 36. The next-lowest indicium in the lefthand column is a symbol representative of zero magnetron power, but of operation in a timing mode. The remaining 10 indicia from bottom to top are 10, 20, 30, 40, 50, 60, 70, 80, 90 and 100% power ratings for the magnetron and are representative of the duty cycle of energization of magnetron 28. Energization of the magnetron 28 is based on a 15 second time base, such that 50% power would energize magnetron 28 for approximately half of that time base, whereas a 100% power value would maintain the magnetron energized across substantially the entire time base. During that portion of each 15 second time base for which magnetron 28 is energized, the lowermost indicium, MAG, will similarly be energized.

The vacuum tube fluorescent display 16 is divided vertically into four so-called "digits", each "digit" being of equal size and containing seven of the display indicia, three being power indicia and four being time indicia. These indicia may be similarly referred to as "segments" or "positions" hereinafter. It should be noted that in the present discussion the "positions" are numbered from 0 to 15 for the 16 time indicia, and 0 to 11 for the 12 indicia in the power column. Thus, in the uppermost digit appear the power values of 80, 90 and 100 at power positions 9, 10 and 11, and the time values of 18, 20, 30, and 45 minutes at time positions 13, 14, 15 and 16. Outputs $O_0$–$O_6$ of microcomputer 36 provide the controls for the seven "positions" (or segments, or indicia) in each of the four digits. Outputs R2–R5 of microcomputer 36 are connected to respective ones of the four digits. The display 16 is driven dynamically by sequentially strobing the digits using a scan rate of 60–100 Hz with a 13.3% "on" time per digit.

The strobe signals appearing on outputs R2, R3, R4 and R5 from microcomputer 36 are additionally extended via respective diodes to respective contacts for each of the data input switches 20B–23B. Further, strobe signals appearing on output ports R0 and R1 of microcomputer 36 are extended to respective contacts on switches 24B and 25B. The opposite contact for each of the switches 20B–25B are connected electrically in common and serve to provide the input lead 95 to microcomputer port K8.

Referring to FIGS. 3 and 4A, it will be appreciated that electrical supply power for the $V_{DD}$ input of microcomputer 36 is available to the primary 45 of transformer 46 from line power terminals L1 and Neutral only if either the relay contact 34'' is closed or one of the key pad switch contacts 20A–23A is closed. Since relay contact 34'' will not be closed without application of the −9 volt supply voltage to the $V_{DD}$ input of computer 36, it is therefore necessary that one of the key pad start-up switches 20A–23A be manually actuated to its closed position to provide a current shunt around the open relay contact 34''. This bypass path must be maintained sufficiently long, i.e., about six line cycles, for the charging of the capacitors in the voltage doubling circuit 56 and the resulting provision of an appropriate regulated supply voltage of approximately −9 volts on lead 65. Once the −9 volt supply voltage is applied to the $V_{DD}$ input of microcomputer 36 and an appropriate RESET signal has been generated and extended via lead 80 to the RESET input, the microcomputer immediately acts to energize power relay 34 and thus close contact 34''. Actuation of a key pad associated with one of the power-up switches 20A–23A is then no longer required for the purpose of applying power to the system. On the other hand, maintenance of that actuation or subsequent reactuation of the respective key pad has the effect of entering data into the system, as will be described.

Figure 5:
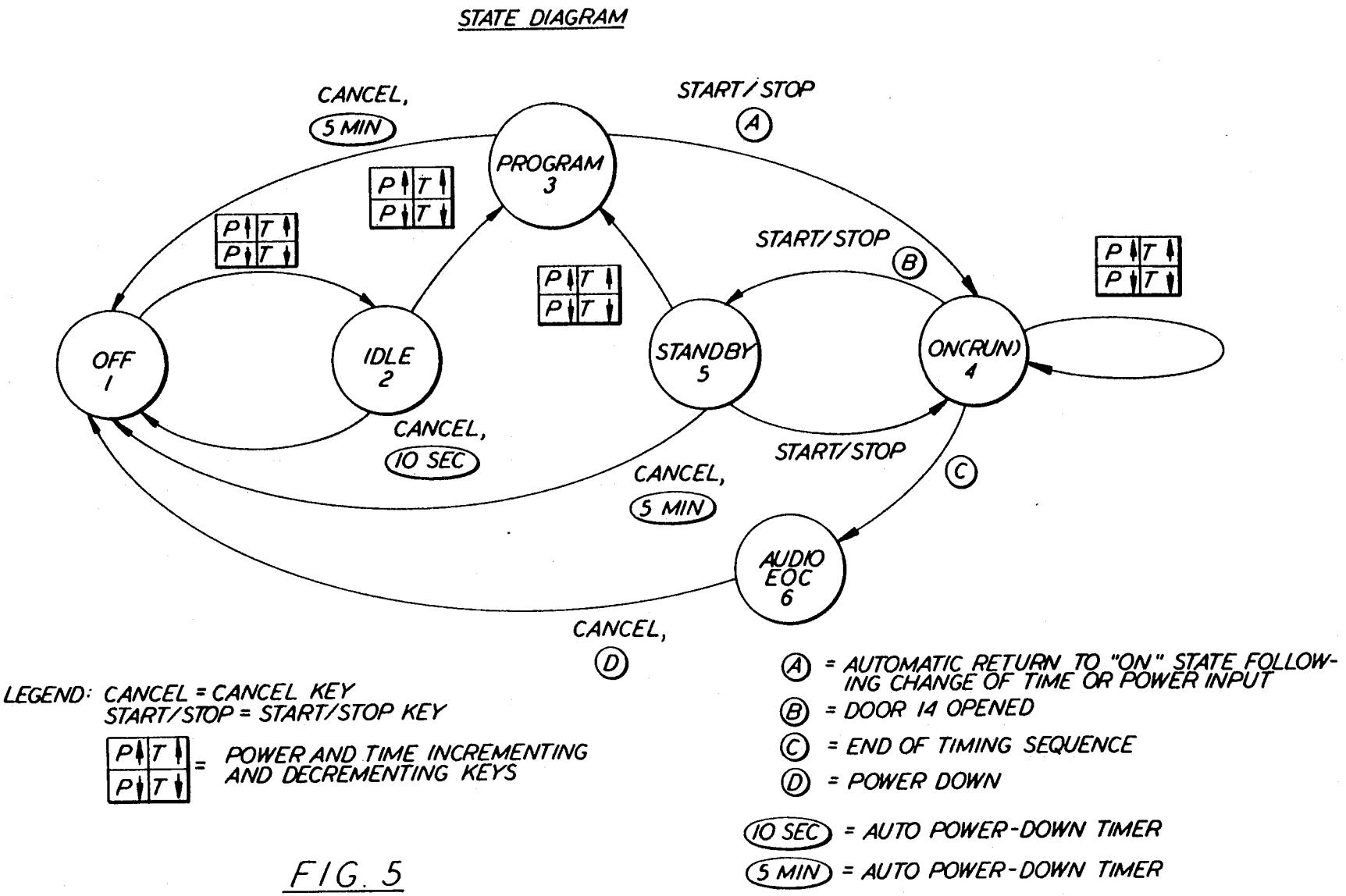
FIG. 5 is a state diagram illustrating the several operating states of the control.

Referring to the general operation of microwave oven 10 and specifically its control panel 12 and the control circuitry generally represented by dotted block 26, attention is directed to the state diagram depicted in FIG. 5. Six different operational "states" or "modes" are depicted. Specifically, the states include OFF, IDLE, PROGRAM, ON (RUN), STANDBY, and AUDIO EOC. The state diagram depiction includes directional arrows or vectors which represent a transition from one state to another and the circumstance, or circumstances, which will occasion such transition. For instance, beginning with the OFF mode, it is only possible to transition to the IDLE mode, and such transition is occasioned by actuation of one of the data key pads 20–23. From the IDLE state, it is possible to transition to the PROGRAM state by virtue of continued actuation or a reactuation of one of the key pads 20–23. It is also possible to transition from the IDLE state back to the OFF state either by actuating CANCEL function key pad 25 or by simply failing to actuate the data key pads 20–23 within a ten second interval after entering the IDLE state to transition to the PROGRAM state. The PROGRAM state accepts the appropriate inputs from the data key pads 20–23 for programming the operation of the control. To effect operation of that program, it is necessary to transition to the ON state, usually by actuation of the START/STOP function key pad 24, but also automatically following a change of the Time or Power inputs via the key pads 20–23 while the system is operating in the ON mode. This latter-mentioned capability is evidenced by the loop depicted at the righthand extreme of the diagram of FIG. 5 which denotes the capability of reprogramming the system "on the fly". The system is also capable of transitioning from the PROGRAM state to the OFF state either by actuation of the CANCEL key pad 25 or by the lapse of five minutes between the entry of data via key pads 20–23 and the subsequent actuation of the START/-STOP key pad 24.

The STANDBY mode is entered from the ON mode either by actuation of the START/STOP key pad 24 or by opening the door 14 while the control system is in the ON state. The STANDBY state is somewhat self-explanatory in that the execution of the program is suspended awaiting some further action. The STANDBY state is left either by returning directly to the ON state by actuation of START/STOP button 24, or by returning to the PROGRAM state either by entering data via key pads 20–23 or by transitioning to the OFF state in response to actuation of the CANCEL key pad 25 or simply by the lapse of a five minute interval of inactivity without actuation of one of the key pads 20–25.

Finally, the system may leave the ON state and return to the OFF state via the optional intermediate AUDIO EOC state. The optional AUDIO EOC state may provide for the sounding of an End Of Cycle Alarm. The AUDIO EOC state is entered by the completion of a timing sequence in the ON state, and subsequently transitions to the OFF state either upon actuation of the CANCEL key pad 25 or via the automatic execution of a programmed power-down sequence which provides a five second delay in lieu of actuation of the CANCEL key pad before actually de-energizing the power relay 34.

A more detailed description of the operation of the control system will now be undertaken. Assuming 60 Hz line voltage is applied to terminals L1 and Neutral, and that the control circuitry 29, 35 and 41 is in the OFF state, the initial manual actuation of any of the data key pads 20–23 results in the actuation of the respective power-up switch 20A–23A to cause electrical power to be applied to the primary of transformer 46 and thereby cause the DC power supply for microcomputer 36 and the related circuitry to build to the proper operating voltages. In the process of powering-up, microcomputer 36 is reset via the RESET input and begins executing its power-up sequence. This sequence insures that the output R7 for the magnetron 28 is OFF; that the output R10 to the auxiliary relay 51 is OFF so as to prevent energization of motor 50; that the power latching relay 34 is energized to thereby close the contact 34" and that the display 16 is flashing on and off. Assuming one of the key pads 20–23 has been depressed sufficiently long for the power latching relay 34 to be energized, i.e., six line cycles, the program of microcomputer 36 places it in the IDLE state.

Upon entering the IDLE state, the scan of the keyboard 17 by microcomputer outputs R0–R5 is begun and a ten second power-down timer is set and begins counting down. If no data key 20–23 remains actuated or reactuated, the power-down counter continues counting for ten seconds (600 line cycles). If time-out occurs, the power latching relay 34 is de-energized and control reverts to the OFF state. On the other hand, actuation of any of the data keys 20–23 for a period longer than three line cycles serves to reset the internal power-down timer and the control transitions to the PROGRAM state. While in the PROGRAM state and immediately following cessation of actuation of a data entry key 20–23, the internal power-down timer is set to count down for five minutes. That timer may be reset by further entry of program data within the five minute interval. Conversely, if the timer times out, the power-up relay 34 is de-energized and the control reverts to the OFF state.

To effect the entry of either time or power via a data entry key 20–23, it is required that the key and its associated switch **20*b*–23*b* be maintained actuated for at least three line cycles to be considered a valid key depression. This interval of three line cycles effectively debounces the switch input. Additionally, an interval of three line cycles must be observed between succeeding key actuations to be discerned as a successive key actuation. Concerning the entry of time data, a single actuation of the time incrementing key 22 will cause the display 16 to stop flashing and the shortest timing interval, i.e., fifteen seconds, to be lighted on the display. This "single actuation" of key 22 may be effected either by a brief continuation of the initial key actuation which moved the control system from the OFF to the IDLE state, or it may be constituted by a brief, discrete second actuation of key 22** following attainment of the IDLE state.

An important aspect of the invention involves the technique for time or power data entry, and involves the slew-entry of data as a function of the continued depression or actuation of a particular data-entry key. In the instance of time data, each of the 16 preselected cooking time intervals is associated with a respective segment or position in the TIME column on display 16. Actuation of either the time incrementing key 22 or the time decrementing key 23 serves to step an internal address counter in an appropriate direction, i.e., up or down, to thereby determine both the selected cooking time interval stored in memory and the corresponding time segment on the display 16. Continued actuation of one of the time or power data keys 20–23 for a period of six line cycles or longer causes the data to increment one step each six line cycles until a prestored limit in the data is reached. Selection of a particular cooking time interval is obtained by either step-actuation or continuous actuation of the appropriate incrementing or decrementing key 22 or 23 until the desired time interval is displayed. Continued actuation of a time incrementing or decrementing key 22, 23 after the display 16 reaches a respective limit serves only to reset the associated five minute power-down timer, but no further change occurs in the displayed and selected time value. If execution of a timing sequence is not started by depressing the START key 24 within five minutes, the control reverts to the OFF state.

In transitioning from the IDLE state to the initial entry of time data, if that initial data entry results from actuation of the time decrementing key 23 for three line cycles, the longest timing interval, i.e., 45 minutes, will be entered in the control and correspondingly displayed on display 16. Subsequent actuation of the time decrementing key 23, either stepped or continuous, causes a corresponding decrementing of the displayed and entered timing interval. Such decrementing continues until the lowermost timing interval of fifteen seconds is reached, whereupon no further change occurs.

Assuming a time data entry key 22 or 23 is the key actuated to effect transition of the control from the IDLE state to the PROGRAM state, the display 16 will illuminate the 100% power level and provide for a corresponding entry of that power level in the control memory. That 100% power level at power-up is termed the "default" power level.

Regarding the entry or selection of a specified one of the predetermined power levels, when a power key 20 or 21 is the first data key actuated to attain, or following attainment of, the IDLE state, stepping or actuation of the power incrementing key 20 serves to discontinue flashing of the power level scale on display 16 and to enter the zero power level. On the display, this power level corresponds with illumination of the timer symbol, which is immediately below the 10% power level. The time scale on display 15 will continue to flash on and off. If such stepping or actuation of the power incrementing key 20 is maintained, the displayed and selected power levels will successively increment until the limit of 100% is reached, whereupon further actuation in that direction is ignored. Conversely, if the power decrementing key 21 is used to effect transition of the system from the IDLE state to the PROGRAM state and to correspondingly enter power data, the initially displayed and entered power level will be that of 100%, and continued stepping or actuation of the decrementing key 21 serves to correspondingly decrement the displayed and entered power levels until only the timer symbol corresponding with zero power level is illuminated.

When only power data has been entered, the time column of the display 16 will continue to flash to remind the user that operation of the system is not possible until one of the time values has been entered. When the START/STOP key 24 is actuated for three line cycles or longer and both time and power data have been entered in the control, the program will begin its execution provided the door 14 is indicated as being closed. However, if only power data has been entered, such actuation of the START/STOP key 24 will not serve to place the control in the ON state.

If, following initiation of operation in the ON state, either one of the power or time keys 20–23 is actuated for at least three line cycles, the system will immediately enter the respective change in power and/or time setting and, upon release of the particular key, will resume operation using the newly-programmed power or time values. Alternately, the START/STOP key 24 may be actuated or the door 14 may be opened to place the control in the stand-by mode, whereupon operation stops. Operation may then be resumed either by reactuating the START/STOP button 24 or by changing the programmed data by actuating the appropriate data key 20–23 and subsequently reactuating the START/-STOP key 24.

When the START/STOP key 24 is actuated to begin normal execution of programmed data, the magnetron 28 is energized at the selected power level duty cycle via output lead 37; the auxiliary drive output controlled by relay 51 and contact 51' is energized, but does not cycle with the magnetron; and the status of door 14 is continuously monitored once each line cycle. Continuous actuation of START/STOP key 24 constitutes a single entry until the key is released for at least three line cycles. A subsequent actuation of START/STOP key 24 after program execution has begun, causes that execution to be interrupted and the output 37 to magnetron 28 is turned off; auxiliary relay 51 is de-energized; and the internal five minute power-down timer begins counting. Actuation of the CANCEL key 25 during execution of a program is ignored. Actuation of CANCEL key 25 is operative to return the control system to the OFF state only if that actuation occurs before execution of a program has begun or after completion of a normal timing interval, as represented by attainment of the audio EOC state.

During slew-entry of the time data, successive ones of the time positions are illuminated. The display-control program operates to illuminate not only the segment or position of the time value selected, but also all of the segments of lesser value. In this way, all of the time segments are activated up to and including the segment or number representing the selected timing interval. As execution of a cooking/timing sequence proceeds, all timing intervals including the one selected remain illuminated until sufficient time has elapsed for the next lower interval to be reached. When that occurs, the illuminated segment of greatest value is then extinguished. This process continues as each successive interval lapses.

Importantly, also, each time segment is representative of some timing interval and that value is automatically set into a counter to effect the timing operation. It would be possible for a selected position on the time scale to set an "up" or a "down" counter to count, or to time, the full interval to time-out. Each successive position or segment on the time scale might be recognized by decoding the count in the counter. Alternatively, in the present embodiment each time position on the time scale has associated with it in memory a predetermined time interval which is representative only of the time difference between that position and the next-lower position. For example, position 11 (12th indicium) in the time scale of display 16 is 15 minutes whereas position 10 is 12 minutes, such that the interval therebetween is three minutes. Accordingly, the value stored in memory for position 11 is a value commensurate with the three minute interval between 15 minutes and 12 minutes. That value is placed in a register and a timer-counter increments until it reaches the same value and is thus determinative of an interval of three minutes having passed. At that instant, the display time position representative of 15 minutes is extinguished and only the "10 minute" and lower values remain illuminated. This process continues on an interval-by-interval basis between each position of declining value in the time scale.

On the other hand, in displaying the selected power level value, only the position or segment corresponding with the selected value is illuminated. The other power levels of lesser value remain extinguished. This format is preferred principally because the selected power level is normally non-varying throughout the execution of the program.

When the end of a timing cycle (EOC) occurs, a corresponding signal is provided at the output R6 of the microcomputer 36. That signal may be a pulse train having a frequency of 2.3 KHz for driving an optional loudspeaker, which has been omitted from the depicted embodiment. When the EOC state is reached, all display indicators are turned off immediately prior to the optional audio annunciation. That audio annunciation will normally continue until switched off by actuation of the CANCEL key 25 or until the EOC state is timed-out by a five second power-down timer, whereupon the system returns to the off state.

Figure 6A:
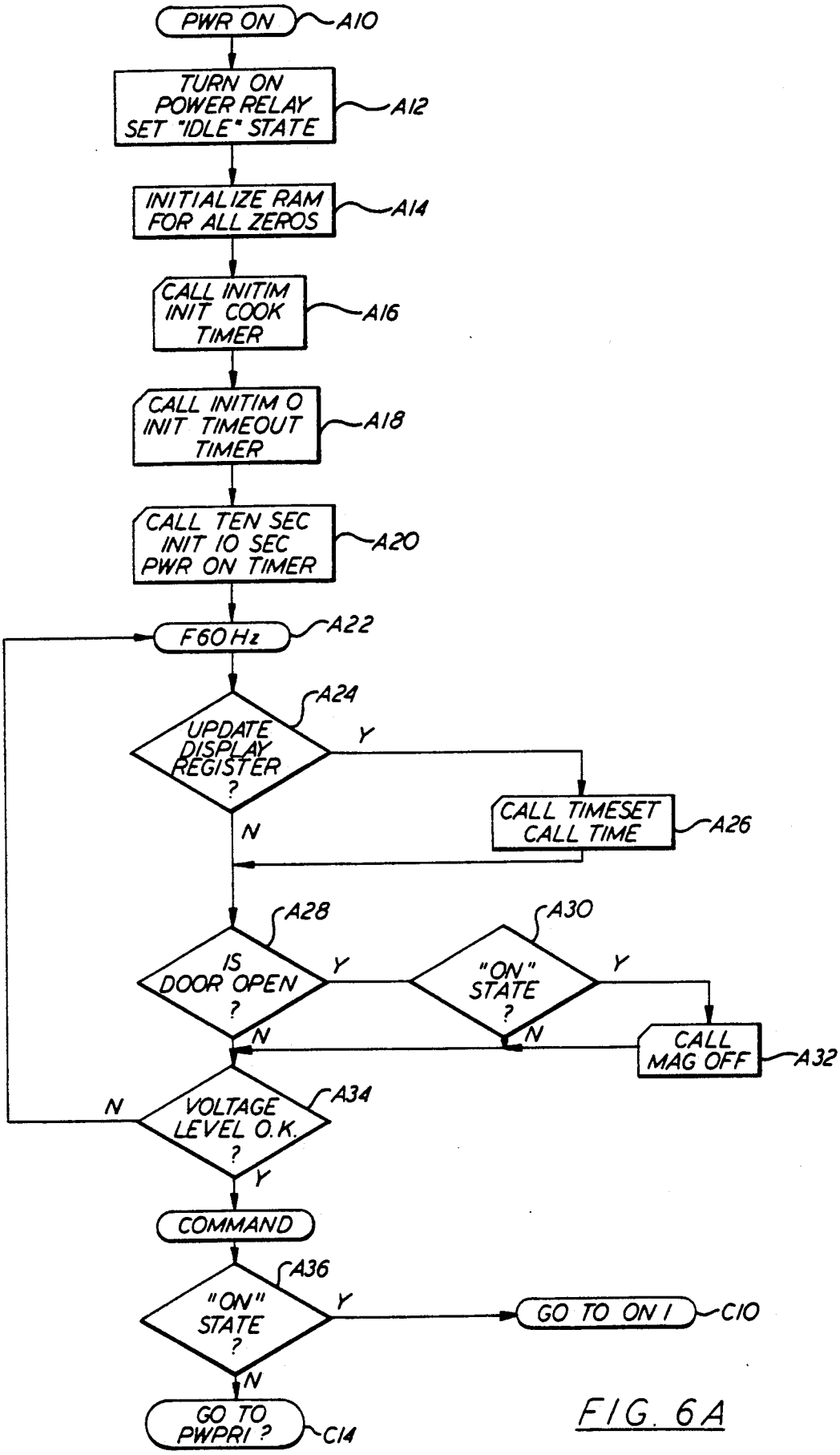
FIGS. 6A–6T are flow diagrams of a portion of the control program incorporated in the microcomputer of the circuit of FIGS. 3 and 4.
Figure 6C:
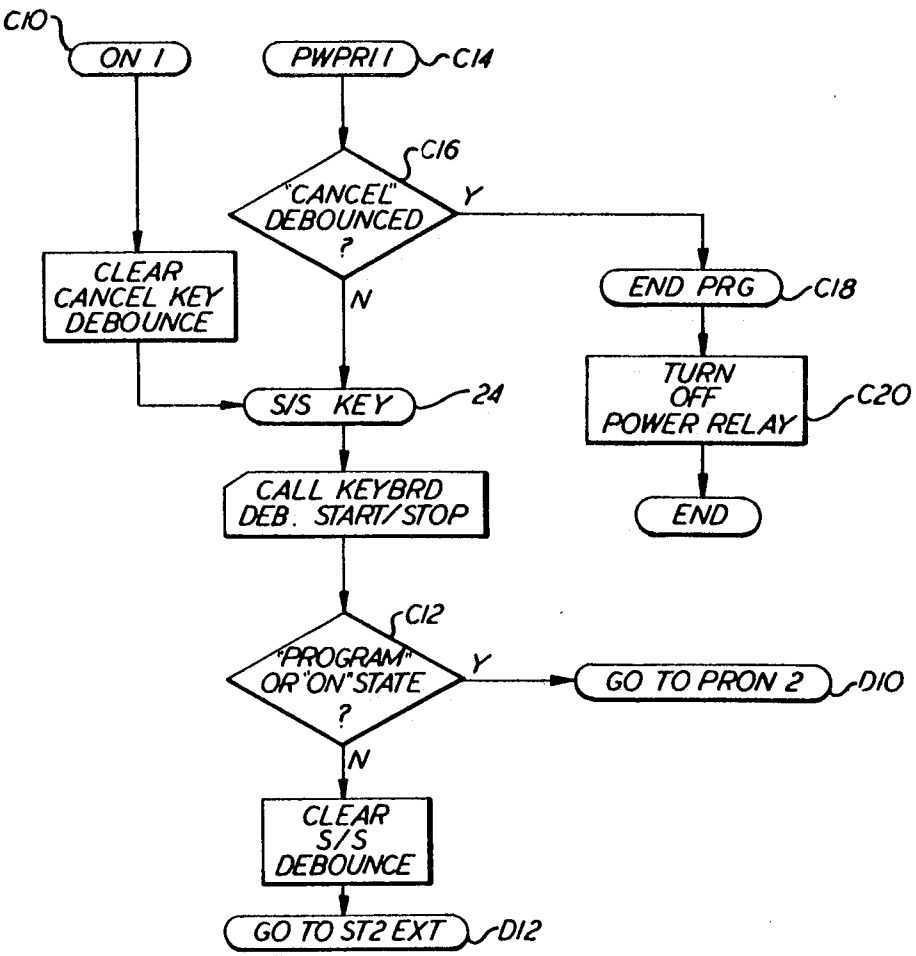
Figure 6B:
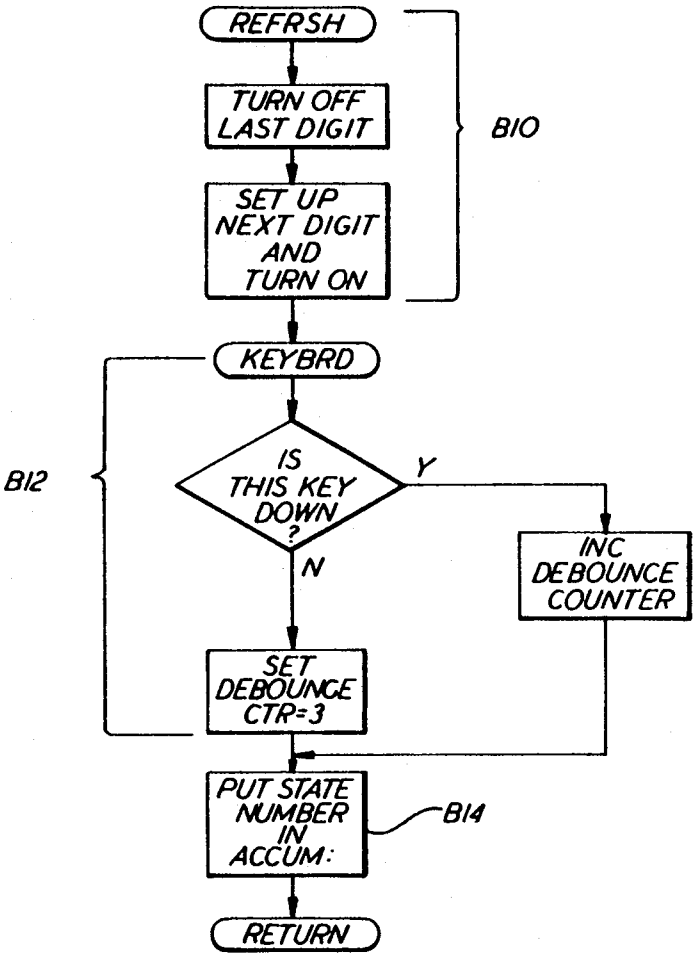
Figure 6D:
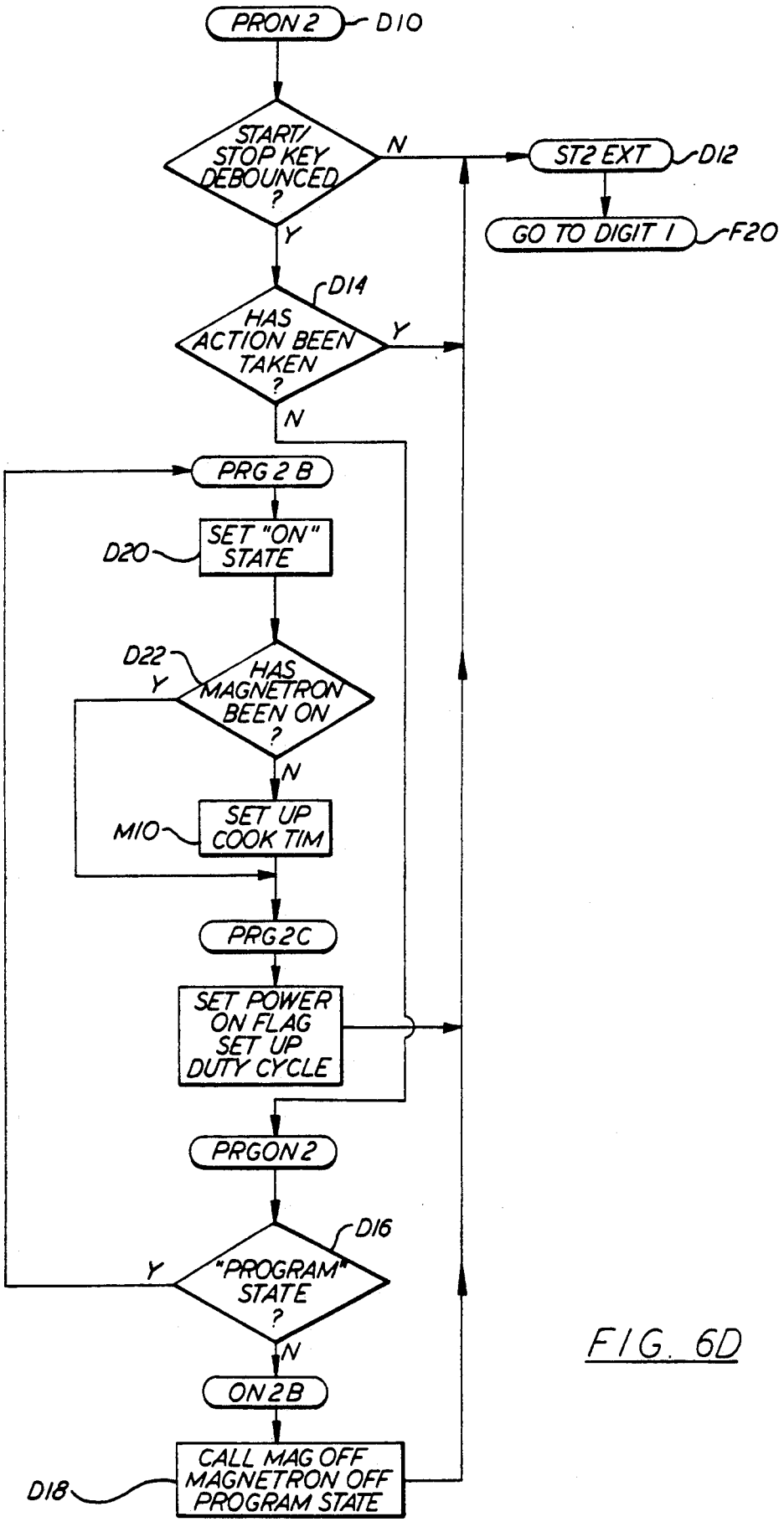
Figure 6E:
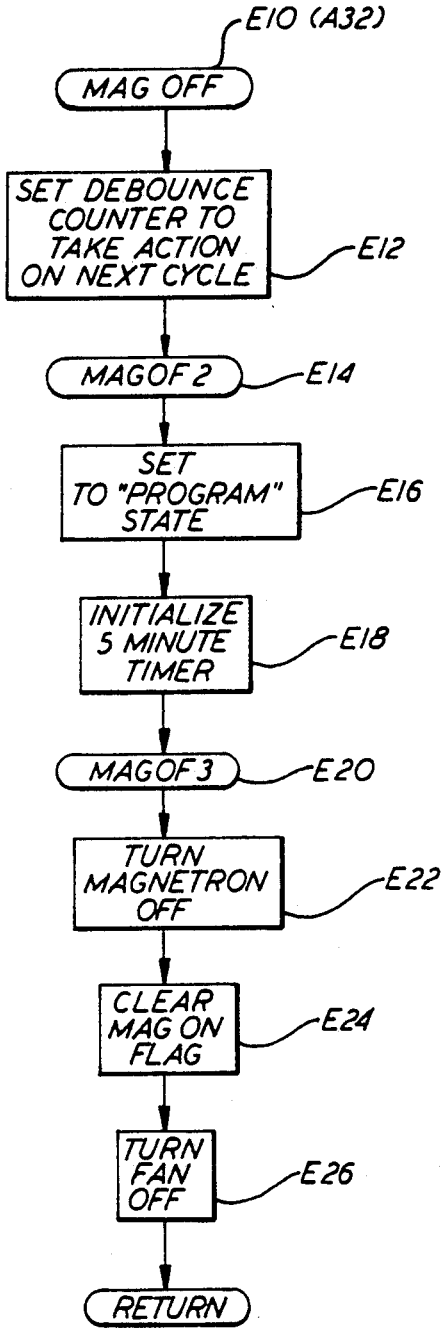
Figure 6F:
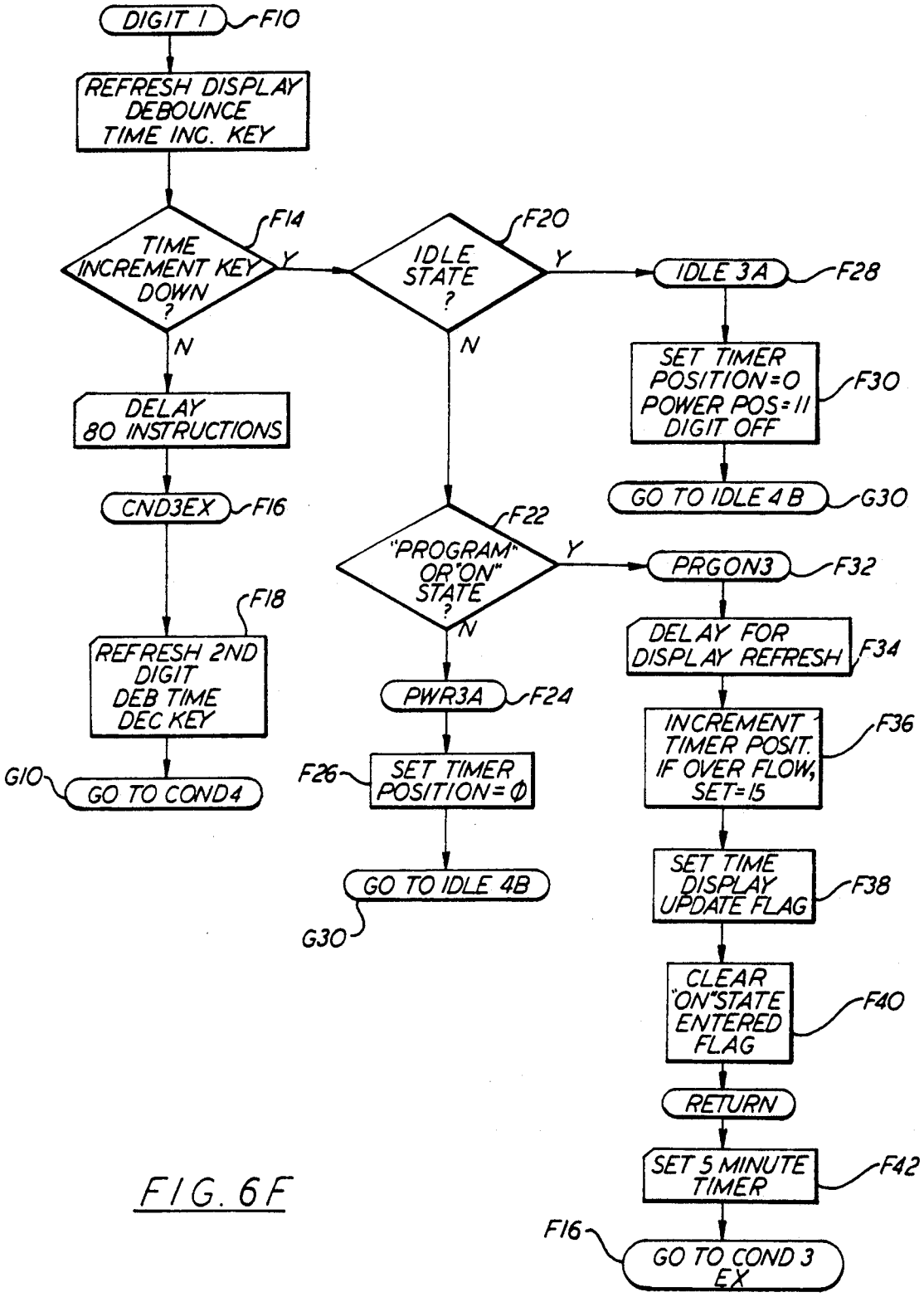
Figure 6G:
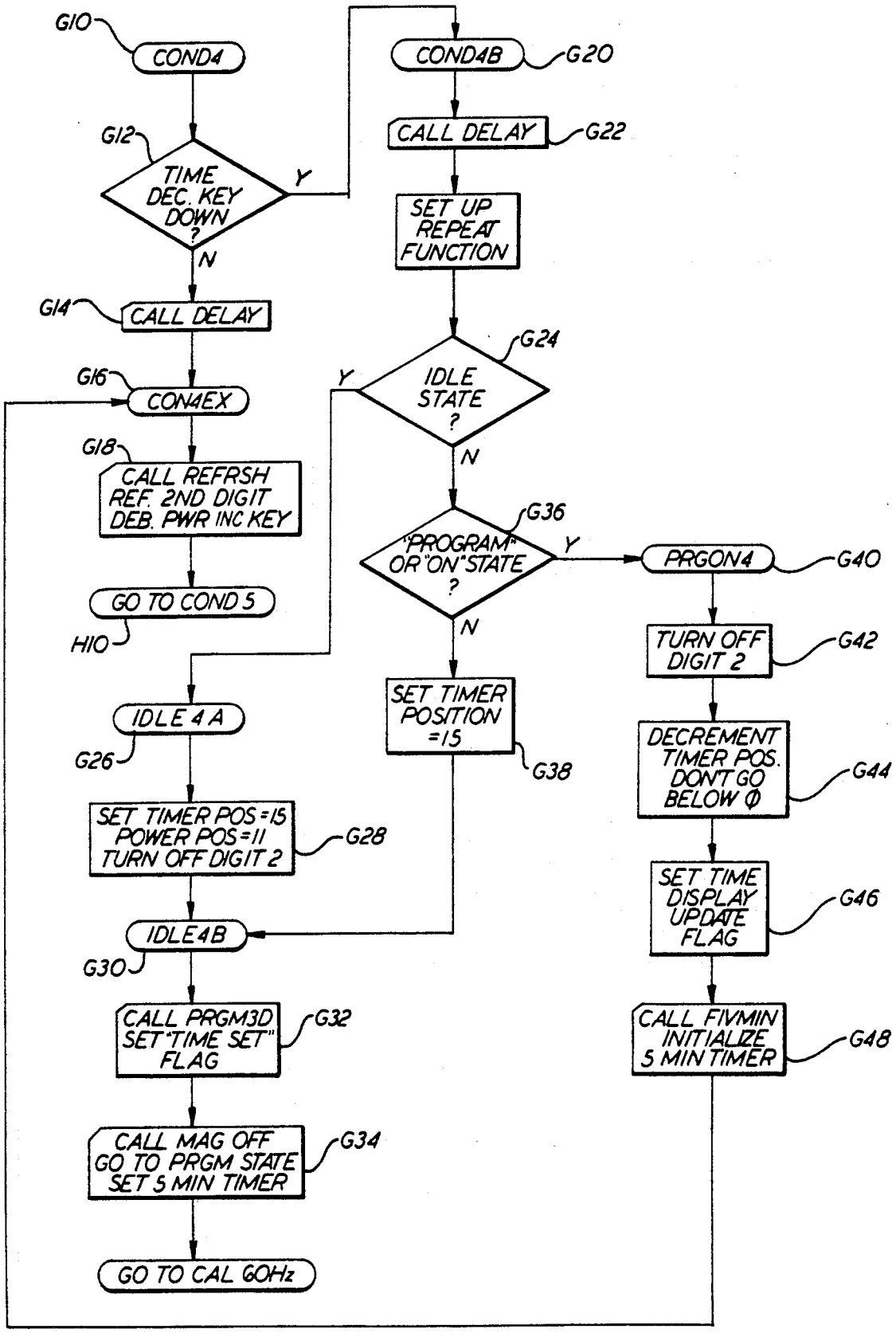
Figure 6H:
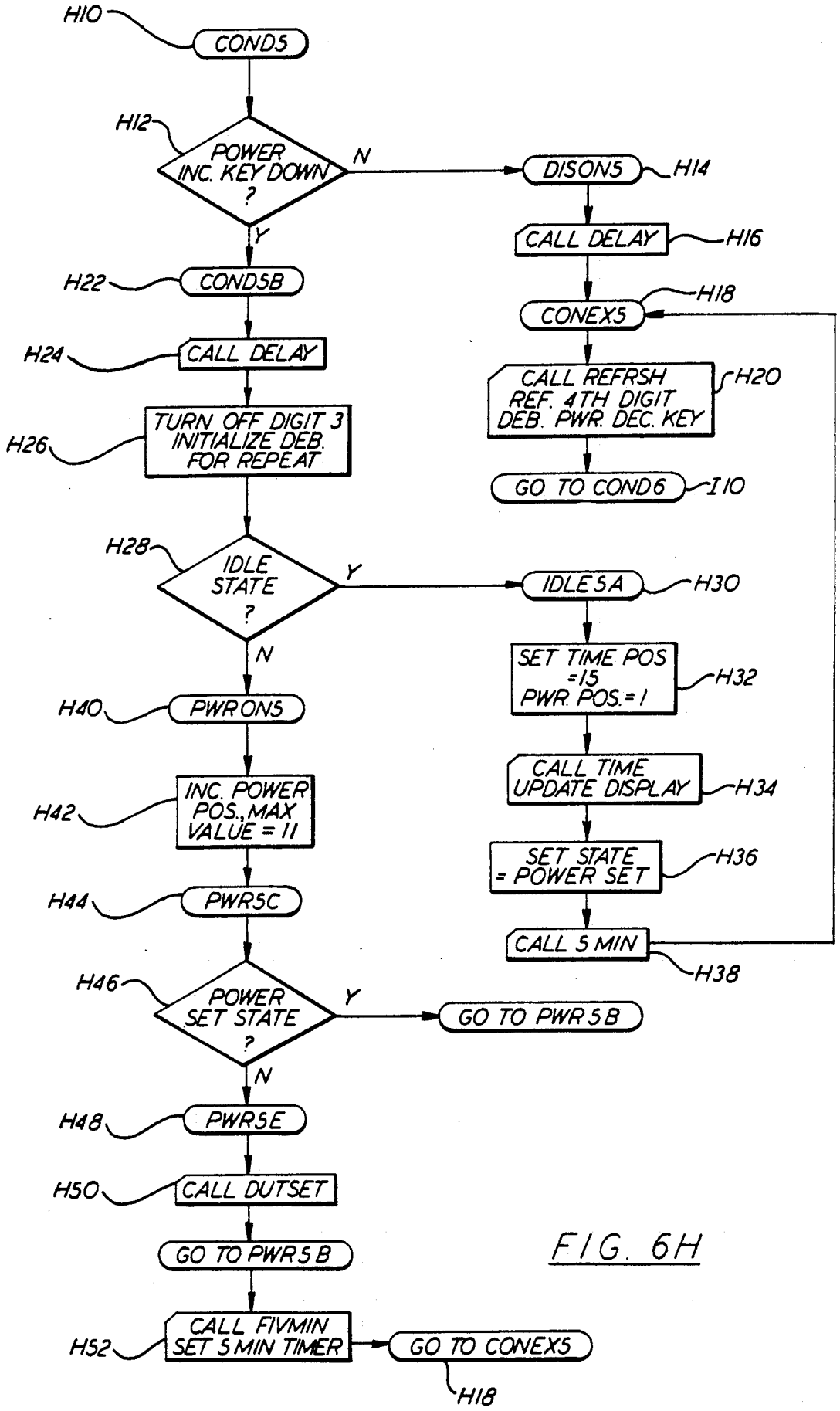
Figure 6I:
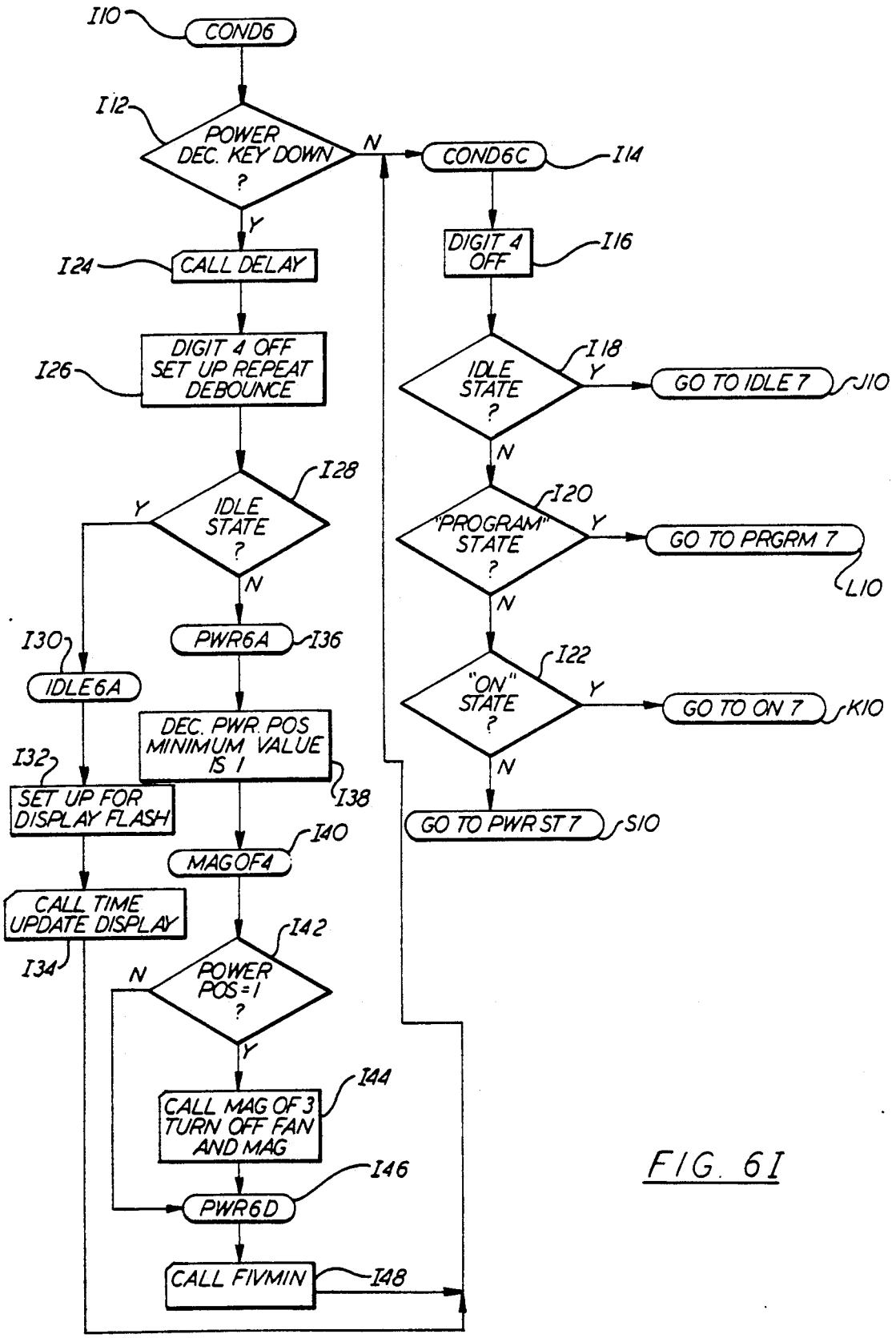
Figure 6J:
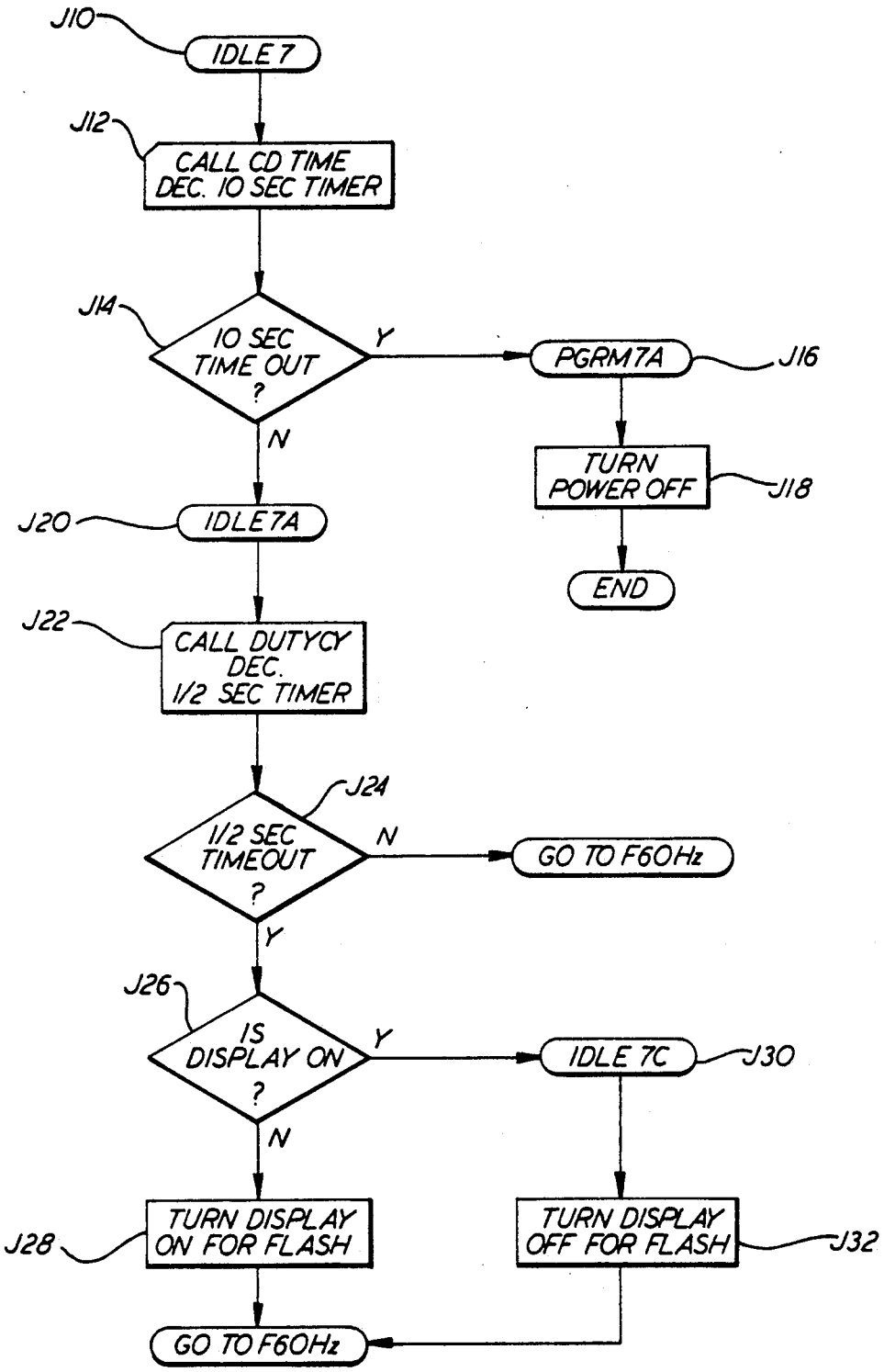
Figure 6K:
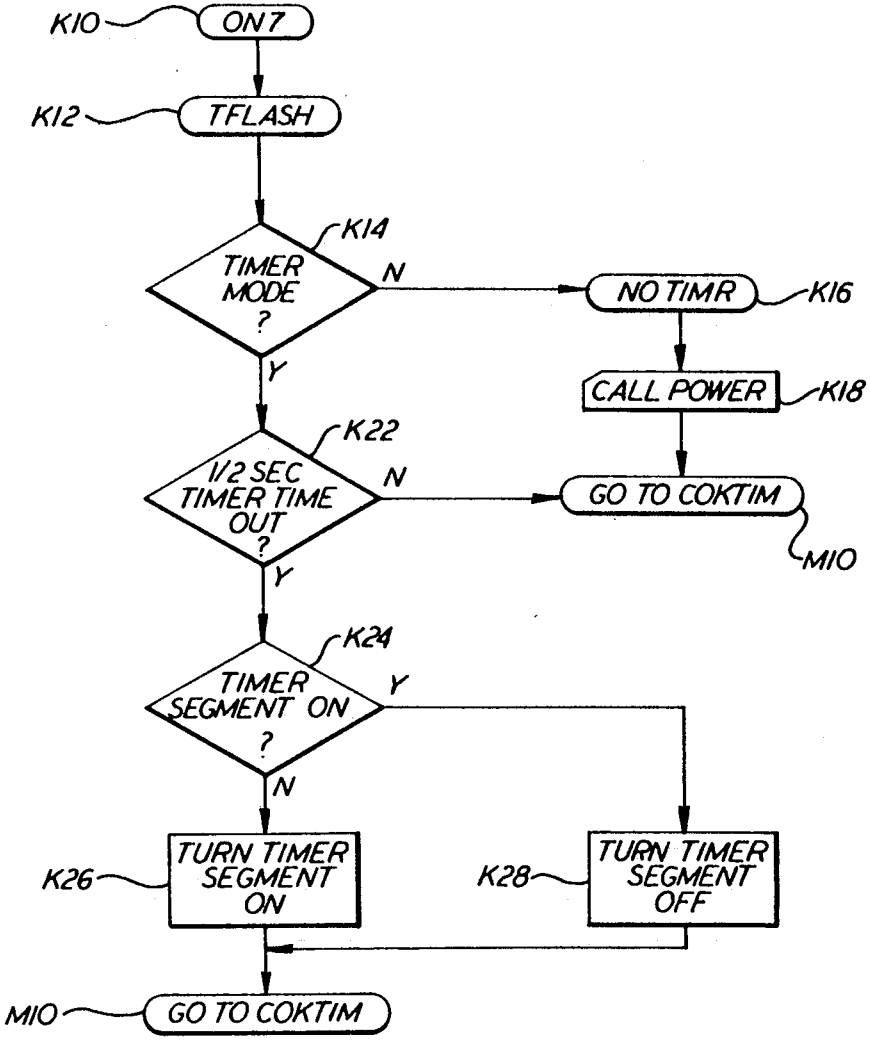
Figure 6L:
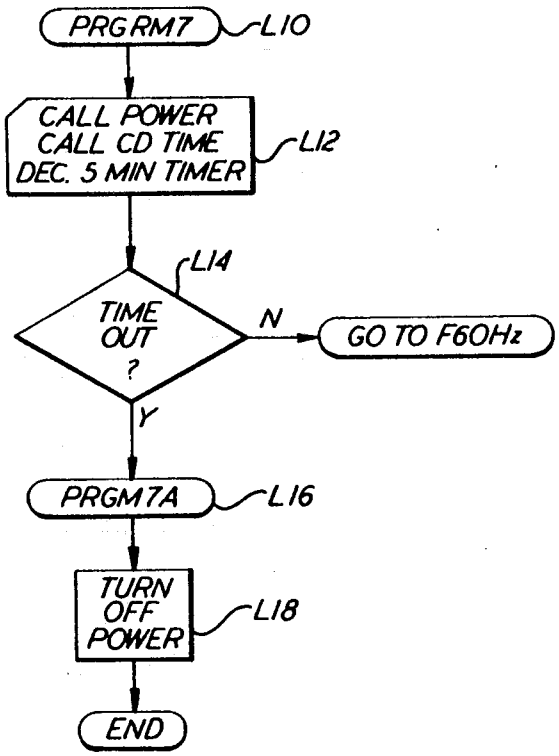
Figure 6M:
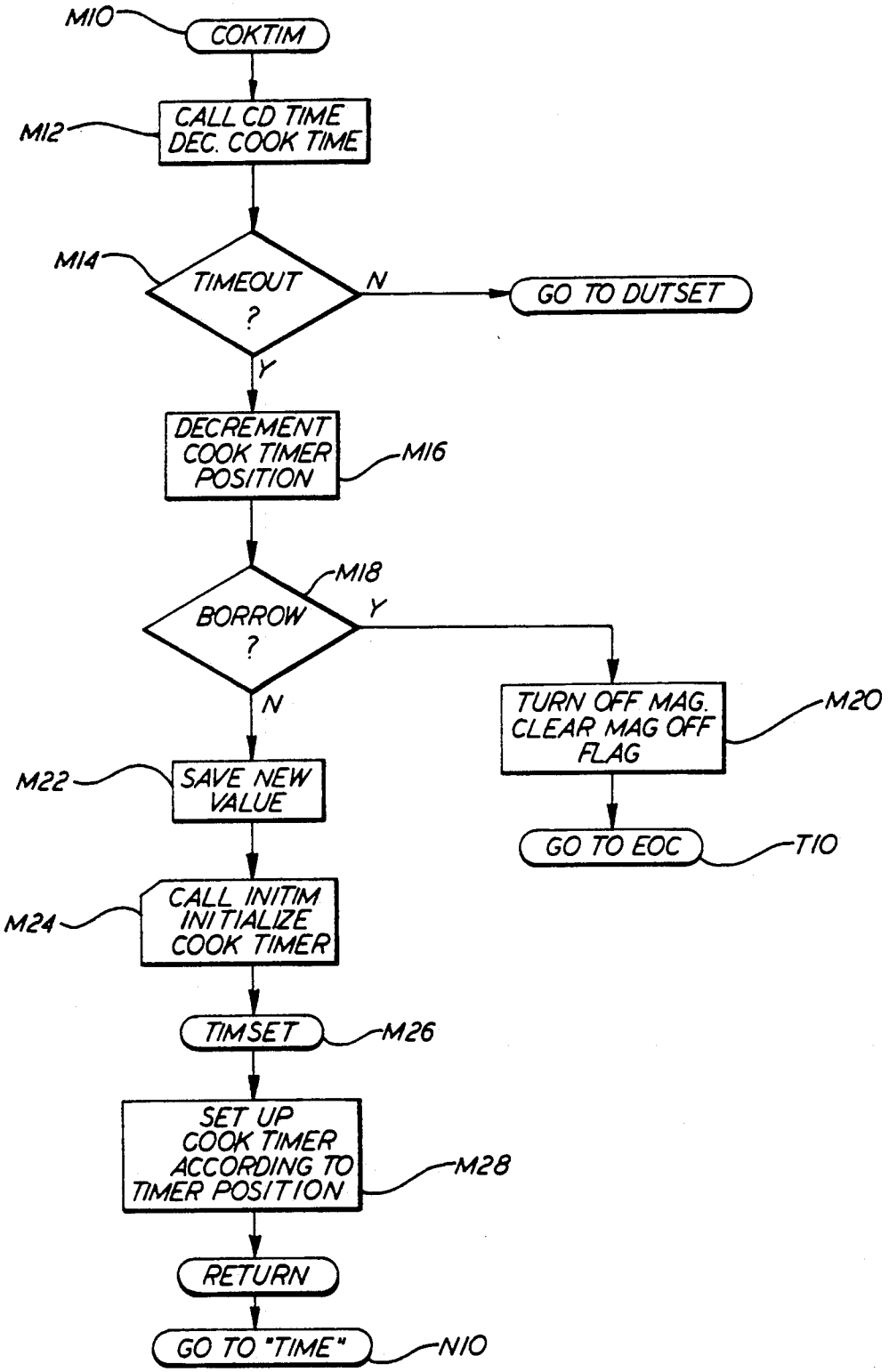
Figure 6N:
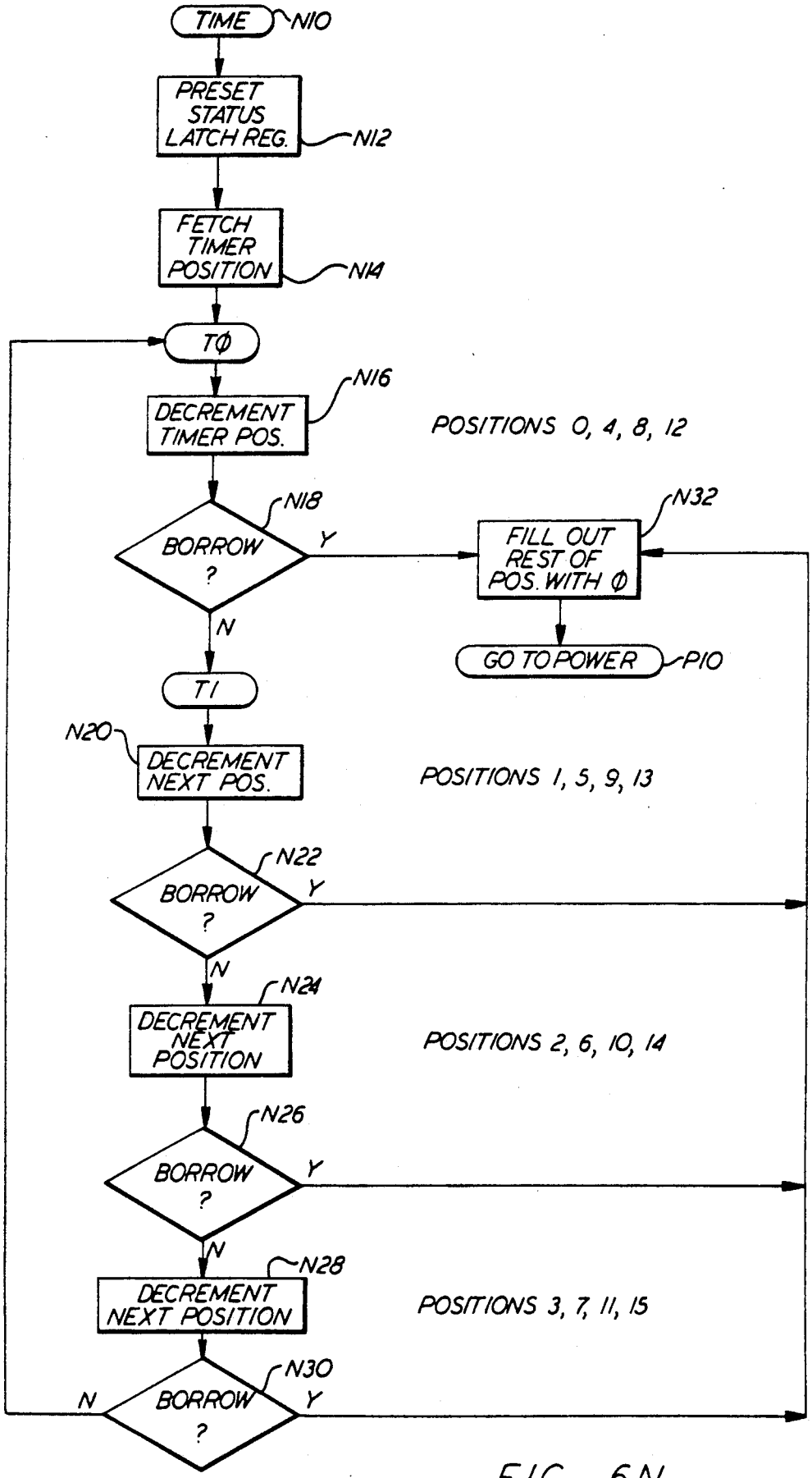
Figure 6P:
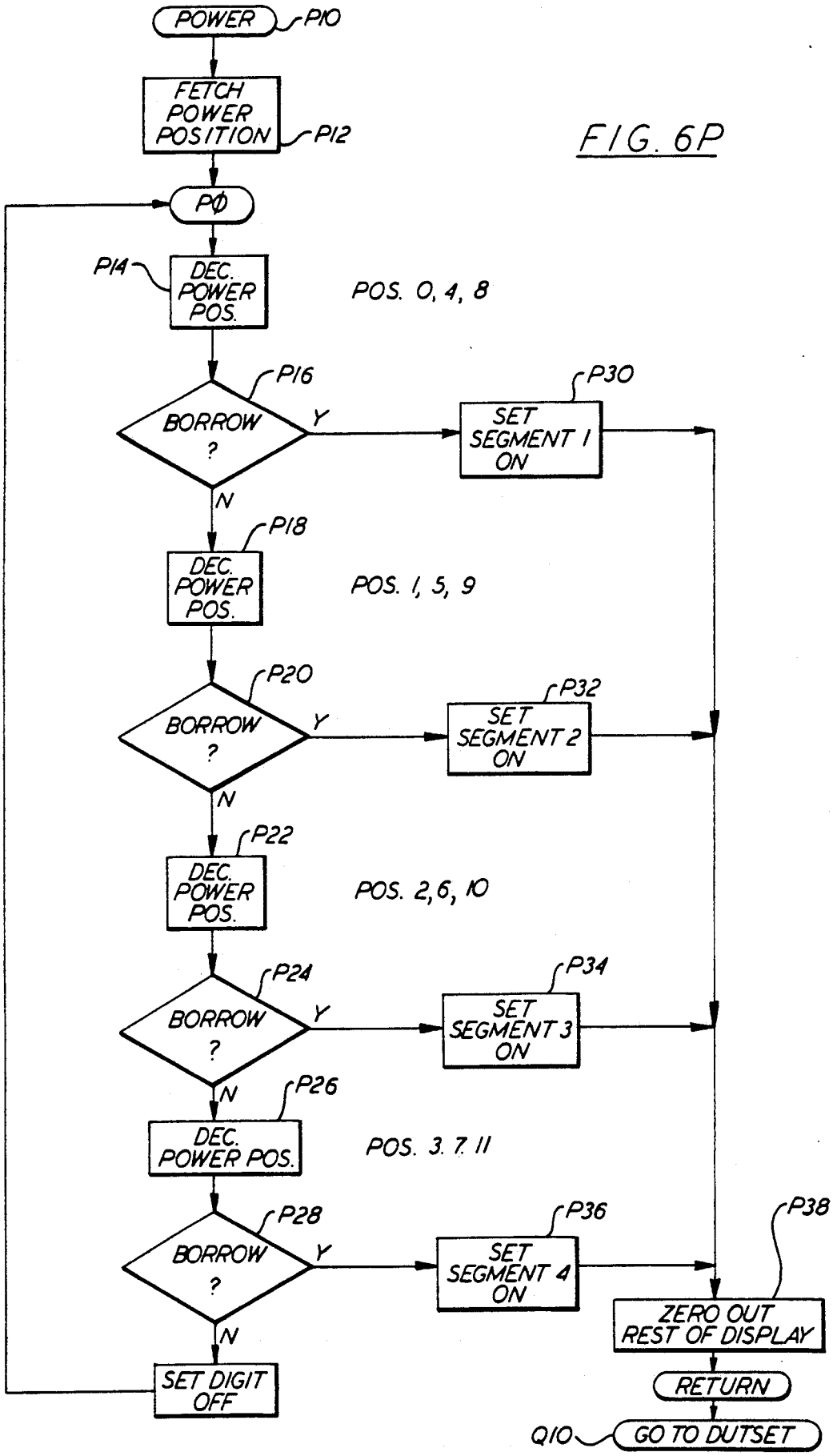
Figure 6Q:
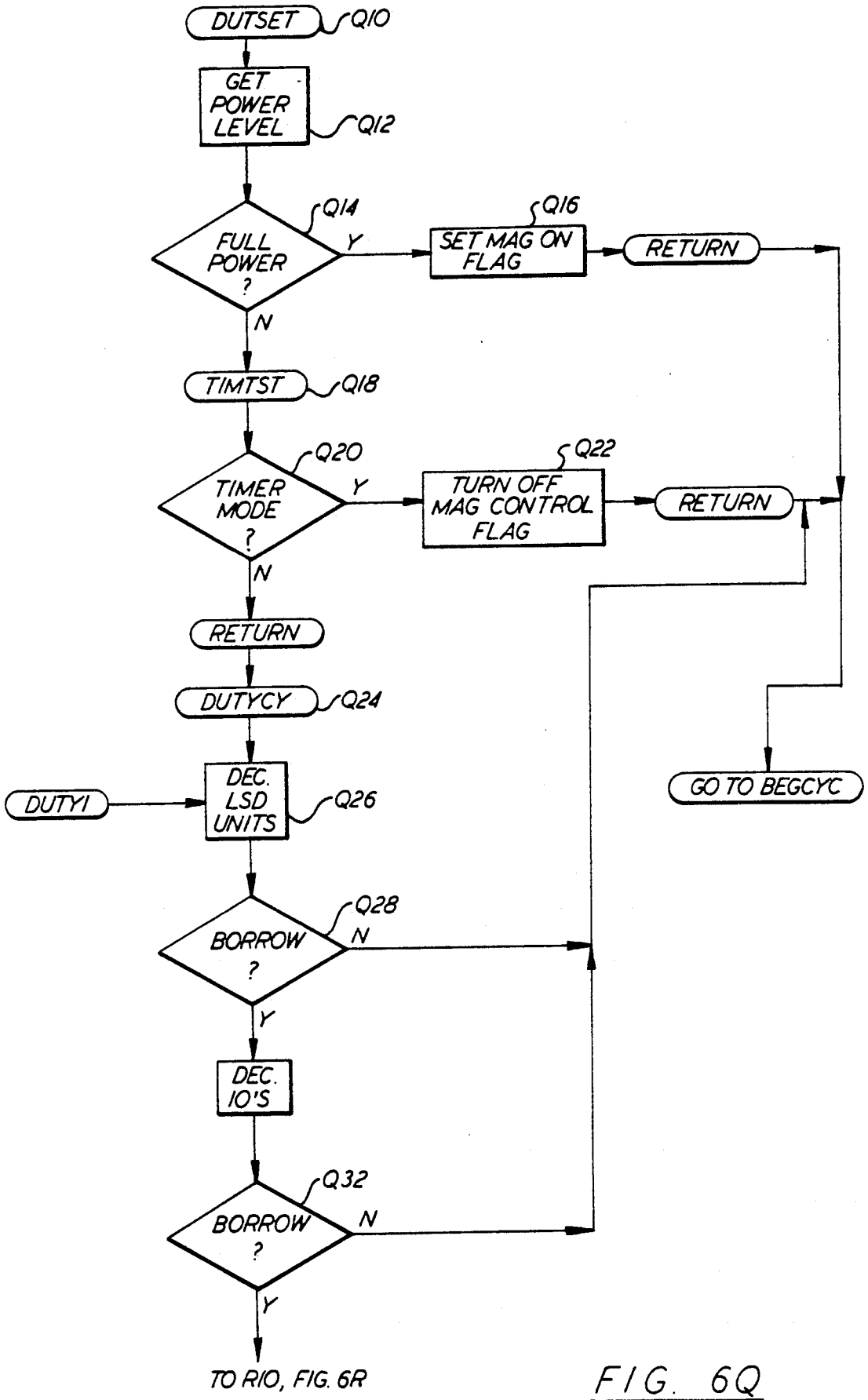
Figure 6R:
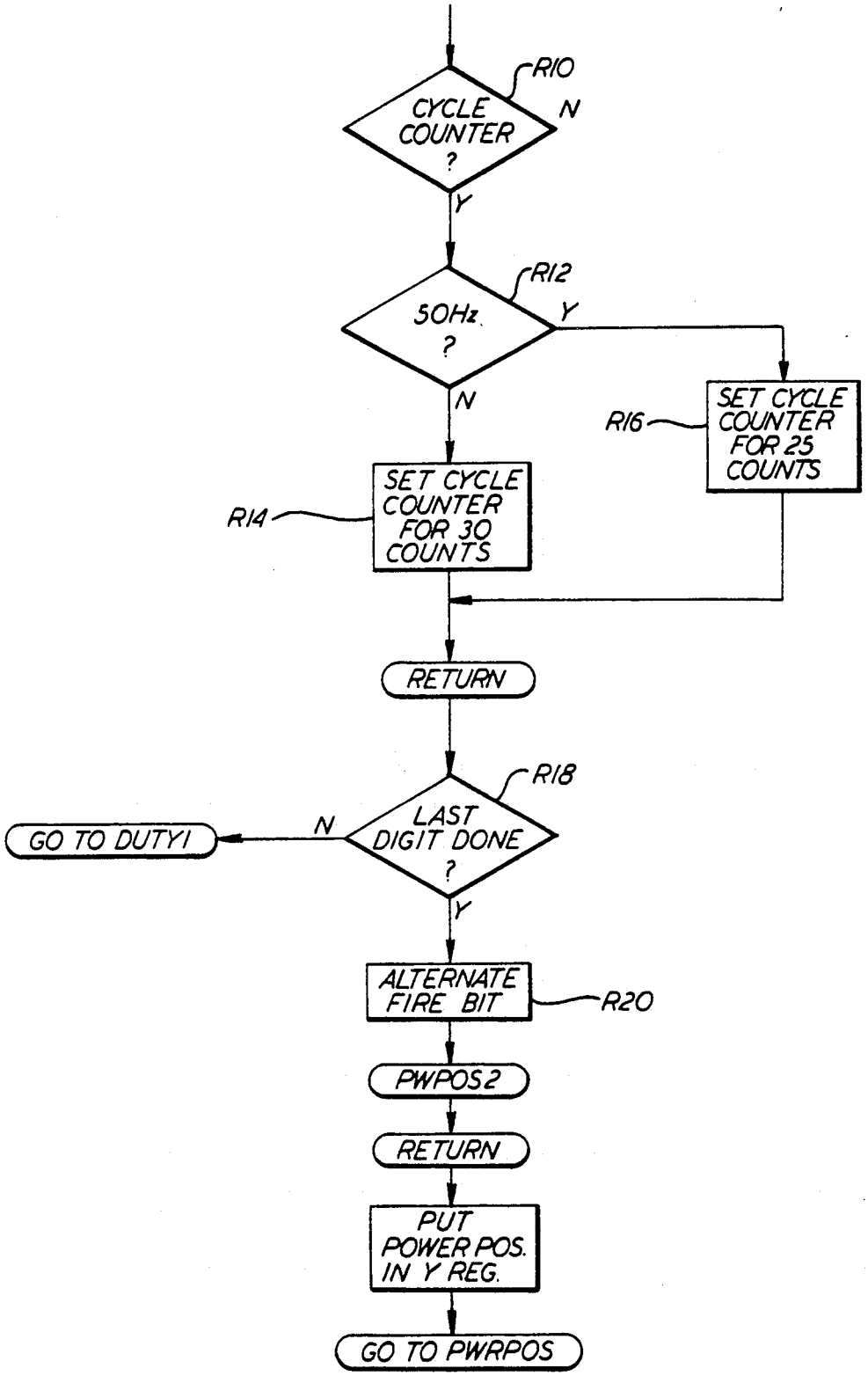
Figure 6T:
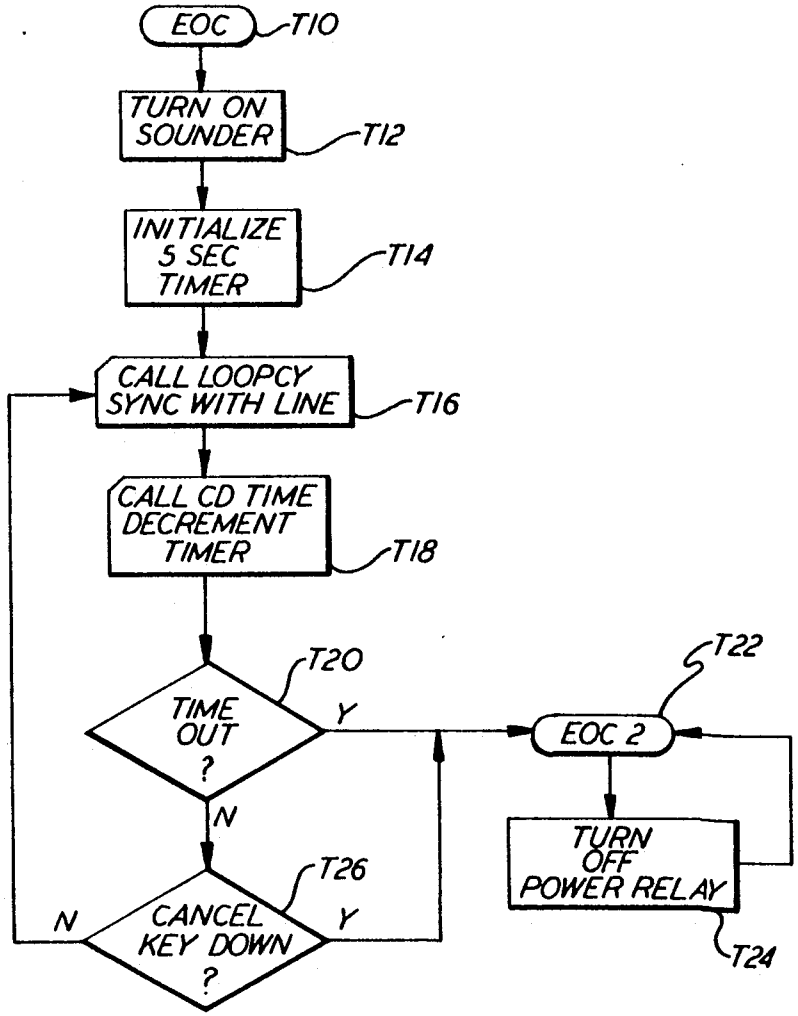

The flow diagrams of FIGS. 6A–6T are referred to for the pictorial depiction of the programmed routines of microcomputer 36. The control routines of these flow diagrams are consistent with the foregoing description and thus relatively little comment is warranted with respect to each of the depicted routines.

FIG. 6A depicts the initial portion of a generalized control routine which is initiated by the application of power to microcomputer 36 (A10) as particularly manifested by the appropriate voltage levels appearing at the $V_{DD}$ and the RESET inputs of the microcomputer. That event serves to energize power relay 34 and to set a flag or register which indicates operation in the IDLE state (A12). The RAM's are initialized to all zeros (A14). The cook timer is initialized (A16). The time-out timer is initialized (A18). A 10 second value is entered in the power-down, time-out timer (A20). Thereafter, provision is made for conducting various functions, typically at the line frequency of 60 Hz (A22), which functions are concerned with the further programming, display and safe operation of the system. The registers associated with the time and power displays are checked to determine if they need updating (A24), and if so, the TIME SET and TIME routines are called. In any event, a continuing check is made via input K4 of microcomputer 36 to determine if door 14 is open (A28) and if it is, whether the system is in the ON state (A30). If it is in the ON state, then the MAG OFF routine is called (A32). Also, a continuing check is made to determine if the voltage level is OK (A34), as determined by the level of the input signal at the RESET input to microcomputer 36. If the voltage level is not OK, a return is made to the normal 60 Hz cycling function. However, if the supply voltage is OK, a determination is made whether the system is operating in the ON state (A36) and corresponding routines are called, depending upon the answer.

Referring to FIG. 6B, the depicted routine is concerned with refreshing the display 16 in a conventional manner (B10) and scanning the keyboard to detect debounced key actuation (B12). A value representative of the appropriate state of operation is placed in the computer's accumulator (B14).

FIG. 6C depicts the routines presented as alternatives for the decision block A36 in FIG. 6A. In the instance of ON1 (C10), the debounce counter for the CANCEL key 25 is cleared and further control comes from actuation of the START/STOP key 24. Actuation of that key is debounced and a determination is made whether operation is in either of the PROGRAM or the ON states (C12) and alternate further routines are directed, depending upon the determination. Had the decision in block A36 in FIG. 6A been "NO", the routine PWPRI 1 (C14) of FIG. 6C would be entered and inspection is made at decision block C16 as to whether the CANCEL key 25 had been actuated and debounced or not. If key 25 had not been debounced, actuation of the START/STOP key 24 is required for further action. If CANCEL key 25 has been actuated and debounced for the requisite three cycles, the routine enters the END PRG routine (C18) which turns off power relay 34 (C20) and terminates all operation of the system.

Referring to FIG. 6D, the alternate exits from the decision block C12 in FIG. 6C are depicted as routines D10 for a "YES" decision and D12 for a "NO" decision. The D12 routine becomes the DIGIT 1 routine depicted in FIG. 6F. If the D10 routine is entered and the START/STOP key 24 is not actuated for the debounce interval, the routine enters the D12 routine. On the other hand, if the START/STOP key is actuated for the debounce interval, a determination is made as to whether or not action has been taken (D14). If it has, the D12 routine is begun. If action has not been taken, the routine asks whether or not the system is operating in the PROGRAM state (D16). If not operating in the PROGRAM state, a call is made for the MAG OFF routine and that the PROGRAM state be set (D18), and the routine moves to the D12 position. If operation is occurring in the PROGRAM state, the system is set to the ON state (D20) and a determination is made as to whether or not the magnetron has been on (D22). If the magnetron has not been on, a call is made to set up the COOK TIME routine M10 depicted in FIG. 6M, and the POWER ON flag is set and the DUT SET routine of FIG. 6Q is set up and the D12 routine is entered. If the magnetron has been on, there is no need to set up COOK TIME, and it is bypassed.

Referring to FIG. 6E, the MAG OFF routine called for in step D18 of FIG. 6D is designated as E10 and begins with the instruction to set the debounce counter to take action on the next cycle (E12). This is followed by a subroutine E14 having instructions to set the system to the PROGRAM state (E16) and an instruction to initialize the five minute timer (E18). Those instructions are followed by a further subroutine (E20) having instructions to turn off the magnetron (E22), to clear the MAG ON flag (E24) and to turn off the fan (E26).

Referring to FIG. 6F, the DIGIT 1 routine (F10) entered as part of the ST2EXT routine D12 in FIG. 6D serves as the starting point for the routine which inspects each of the data keys 20–23 for data-entering actuation. Those routines are cumulatively depicted in FIGS. 6F–6I. In FIG. 6F, an instruction calls for refreshing the display and for debouncing the TIME INCREMENT key (F12). A determination is made as to whether the TIME INCREMENT key is actuated (F14) and if not, operation is delayed for 80 instructions to maintain display brightness and then a subroutine COND 3EX (F16) is entered which calls for refreshing the second grid or digit in the four-digit display 16 and for debouncing the TIME DECREMENTING key (F18) and moving to routine COND 4 (G10). If at block F14 the TIME INCREMENT key 22 had been actuated, a determination is made whether the system is in the IDLE state (F20) and if it is not, a further determination is made as to whether the system is in either of the PROGRAM or ON states (F22) and if not, a subroutine PWR 3A is entered (F24) to set the timer position to zero (F26) and then to go to routine IDLE 4B. If at F20 the system were in the IDLE state, a subroutine IDLE 3A (F28) would be entered which included the instructions to set the timer position to zero; set the power position to 11 and to turn off the display grid, DIGIT OFF (F30) and then to go to routine IDLE 4B. If at block F22 the system were found to be operating in either the PROGRAM or ON state, the PRGON 3 routine (F32) would be entered and includes instructions to delay for display REFRESH (F34); then increment the timer position and if an overflow occurs to set to 15 (F36); to set the TIME DISPLAY UPDATE flag (F38) to refresh the display; to clear the ON state entered flag (F40) and then set a five minute time-out, power-down timer (F42) and go to the COND 3EX routine.

Referring to FIG. 6G, routines COND 4 (G10) is entered and a determination is made whether the TIME DECREMENT key 23 is actuated (G12) and if not, an 80 instruction delay (G14) is called for refreshing the display and then for entering a routine COND 4EX (G16) which calls for refreshing the second digit or grid of the display and debouncing the POWER INCREMENTING key 20 (G18) and then going to routine COND 5. If the TIME DECREMENTING key had been actuated at G12, a routine COND 4B (G20) is entered and an 80 instruction delay (G22) is entered to refresh the display and a determination is made (G24) whether the system is in the IDLE state. If in the IDLE state, a routine IDLE 4A (G26) is entered and includes an instruction to set the timer position to 15; to set the power position to 11; and to turn off the second digit of the display (G28); then to enter a further routine IDLE 4B (G30) having instructions to call PRGM 3D and to set TIME SET flag (G32) and to call MAG OFF and go to PROGRAM state and set the five minute timer (G34), then go to CAL 60H. If at G24 it had been determined the system was not in the IDLE state, a determination would be made whether the system was in either the PROGRAM or the ON state (G36) and if it is not, to set the timer position to 15 (G38) and to enter the routine IDLE 4B (G30). If at G36 the system was found to be in either the PROGRAM or the ON state, a routine PRGON 4 (G40) is entered and instructs the turn off of the second digit in the display (G42); the decrementing of the timer position, but not below zero (G44); the setting of TIME DISPLAY UPDATE flag (G46) and the initializing of the five minute power-down timer (G48) and thence a return to the SECOND 4EX routine at G16.

Referring to FIG. 6H, the routine COND 5 (H10) is entered by determining whether the POWER INCREMENTING key 20 is actuated (H12) and if not, then entering a routine DISON 5 (H14) which calls for an 80 instruction delay (H16) and a further routine CONEX 5 (H18) which calls for refreshing the fourth digit of the display and debouncing the POWER DECREMENTING key 21 (H20) and moving to routine COND 6. If the POWER INCREMENTING key had been actuated at H12, a routine COND 5B (H22) is entered and calls for a delay to refresh the display (H24) and the turning off of digit 3 in the display and the initialization of the debounce counter (H26). Then a determination is made whether the system is in the IDLE state (H28) and if it is, then a routine IDLE 5A (H30) is entered which instructs that the time position be set to 15 and that the power position be set to one (H32); that the TIME DISPLAY update be called (H34); that a flag representing a POWER SET state be set (H36); and that a five minute time-out timer be set (H38) and then the routine CON EX5 of H18 is entered. If at decision block H28 it had been determined that the system was not in the IDLE state, a routine PWP ON5 (H40) provides for incrementing the power position up to a maximum value of 11 (H42) and then a routine PWR 5C is entered (H44). That routine asks whether or not the POWER SET state exists (H46) and if so, goes to routine PWR 5B. If the POWER SET state does not exist, a routine PWR 5E (H48) is entered and the DUTSET is called for setting the duty cycle (H50) and a routine PWR 5B is entered which sets the five minute time-out timer (H52) and then goes to routine CON EX5.

FIG. 6I depicts routine COND 6 (I10) which asks whether the POWER DECREMENTING key 21 is actuated (I12) and if it is not, routine COND 6C (I14) is entered and instructs that display digit 4 be turned off (I16) and a determination is made whether or not the system is in the IDLE state (I18). If it is, the IDLE 7 routine is entered and if not, a detemination is made as to whether it is in the PROGRAM state (I20). If it is, the PRGRM 7 routine is entered, and if not, a determination is made as to whether the system is in the ON state (I22). If it is, the ON 7 routine is entered and if not, the PWRST 7 routine is entered. If the POWER DECREMENTING key had been actuated at I12, a delay is called for refreshing the display (I24) and the fourth digit of the display is turned off and the debounce is set up (I26). A determination is then made whether the system is in the IDLE state (I28) and if it is, then routine IDLE 6A (I30) is entered and instructions call for setting up a flashing of the display (I32) and for calling TIME DISPLAY update (I34) and thence an entry into routine COND 6C (I14). If at I28 the system were not in the IDLE state, routine PWR 6A (I36) is entered and the power position is decremented, but not beyond a minimum value of one (I38), and routine MAGOF 4 (I40) is entered and a determination is made of whether the power position is one (I42). If the power position is "one", routine MAGOF 3 is called and the fan and the magnetron are turned off (I44); a routine PWR 6D (I46) is entered; a five-minute time-out timer is set (I48); and the routine COND 6C at I14 is entered. If at I42 the power position was not "one", routine PWR 6D at I46 is immediately entered.

Referring to FIG. 6J, the routine IDLE 7 (J10) is entered by calling for the cycle decrement (CD) (TIME) and a setting of the 10 second timer (J12), and a decision block (J14) determines whether a 10 second time-out has occurred. If that time-out does occur, a routine PRGM 7A (J16) is entered and the power relay 34 is turned off (J18) and the system is shut down. If the 10 second time-out has not occurred, routine IDLE 7A (J20) is entered and the DUTY CY routine is called and the one-half second timer is decremented (J22). The one-half second timer is monitored to determine whether or not it has timed-out (J24) and if it has not, the routine goes to F60 Hz, but if it has timed-out, a further query is made as to whether the display is ON (J26). If the display is not ON, an instruction is sent to turn the display on for flashing (J28) and a return is made to F60 Hz. If the display had been on, routine IDLE 7C (J30) is entered and an instruction is called to turn off the display (J32), thereby completing a flashing cycle, and return is made to F60 Hz.

Referring to FIG. 6K, the routine ON 7 (K10) of FIG. 6I is entered with a routine JFLASH (K12) which initially asks if the system is operating in the timer mode (K14) and if it is not, a NO TIMER routine (K16) is entered, at which point the POWER routine is called (K18) and following which the control moves to the COOK TIME routine. If the system were in the TIMER mode at K14, a determination is made as to whether the one-half second timer has timed-out (K22) and if not, the program enters the COKTIM routine. If the half-second timer of K22 has timed out, a determination is made as to whether the timer segment of the display is "on" (K24) and if it is not, an instruction is made to turn the segment "on" (K26) and the routine goes to COKTIM. If the timer segment had been "on" at K24, an instruction is given to turn the timer segment "off" (K28) and then to go to the COKTIM routine.

Referring to FIG. 6L, routine PRGRM 7 (L10) of FIG. 6I is entered and an instruction is issued to call the POWER and the CD TIME routines and to decrement the five-minute timer (L12). It is then determined if the five-minute timer has timed-out (L14) and if not, the routine goes to F60 Hz. If the five-minute timer has timed out at L14, a routine PRGM 7A is entered (L16) and the power to relay 34 is turned off (L18) and the system is shut down.

The CD TIME routine referenced in some of the afore-described flow diagrams is of relatively conventional form and serves a basic time counting function by decrementing a timer with each line cycle. Provision is made for responding to either a 50 or a 60 Hz line frequency signal. Because of the conventional structure of the CD TIME routine, it will be given no further discussion.

Referring to FIG. 6M, the COOK TIME routine M10 of FIG. 6K is entered and calls for the CD TIME routine and for decrementing the cook time (M12). It should be noted that in the present embodiment, each interval of time between successive time indicia on the display 16 is treated as a discrete time interval which is counted down to zero, such that it is at parity with the next lower time value. Accordingly, a determination is then made as to whether or not the immediate time interval has timed-out (M14) and if it has not, the DUT SET routine is entered. If, however, the immediate cook time inverval has timed-out at M14, an instruction is issued to decrement the COOK TIMER position (M16). This has the effect of decrementing the time scale of display 16 by then extinguishing the largest time indicium which was being displayed. When the COOK TIMER is decremented at M16, a determination is made as to whether such action would attempt to decrement below the zero time position (i.e. borrow) (M18), and if it would, the magnetron is turned off, the MAG OFF flag is cleared (M20) and the routine goes to EOC. If the decrementing step of M16 did not require a borrowing at M18, then cooking time remains and the new COOK TIMER position value is retained (M22) and an instruction is issued to initialize the COOK TIMER (M24) via the TIM SET routine (M26) which sets up the COOK TIMER with an interval which corresponds with the time between the present timer position and the next-lower timer position (M28). The routine then goes, via a return instruction, to the routine for controlling the display of TIME (N10).

Referring to FIG. 6N, there is displayed TIME routine (N10) which controls which of the indicia in the time column at the righthand of display 16 are to be energized, or illuminated. An instruction is included to "PRESET STATUS" and to latch "REGISTER" (N12). Next is an instruction to fetch the "TIMER POSITION" (N14). The TIMER POSITION is a number representative of one of the positions between zero and 15 which correspond with the sixteen different time values appearing on the display panel 16. Next, the TIMER POSITION extant during that period of operation and fetched at N14 is decremented by one unit (N16). A determination is then made whether such decrementation required a borrowing operation (N18). A borrowing operation would have been required only if the TIMER POSITION had not been greater than zero. Assuming the original TIMER POSITION fetched at N14 had been one or more, there would have been no need to borrow and the routine would again decrement the new value by one unit (N20) and again determine whether there was a need to borrow (N22). Assuming another negative response, such operation is repeated two more times (N24), (N26), (N28) and (N30), following which a further negative response returns the routine to the N16 position. It will be understood that the operations at N16, N18 are concerned with the display digit, or grid, of least significant value, the operations of N20 and N22 with the grid of next greater value, the operations of N24 and N26 with the grid of next greatest value, and the operation of N28 and N30 with the grid of greatest value. Further, the scan of the display positions starts with the lowest value of time, i.e. 0 position (15 sec), then the 1 position (30 sec), etc. Moreover, if at any one of the "BORROW" decision blocks N18, N20, N26 and N30 it had been necessary to borrow, thus indicating that the TIMER POSITION had reached zero, the routine would branch to an instruction (N32) which would provide that all the remaining timer positions would be filled out with zeros, or in other words, would not be illuminated. Stated another way, if the timer position fetched at N14 had been, for example, the 11th position, which corresponds with 15 minutes on the display scale 16, the first "NO" determination at N18 would have permitted illumination of the indicium in the "zero" position of the timer, or in other words the 15-second indicium. Next, a "NO" determination at N22 would have permitted illumination of the time indicium in the "one" position of the timer, i.e. 30 seconds. This process would continue until it were found necessary to "BORROW", whereupon the remaining indicia on the display time scale would remain extinguished. After the remaining indicia on the time scale are blanked at N32, the routine goes to the "POWER" routine (P10).

Referring to FIG. 6P, there is displayed the "POWER" routine (P10) which controls which indicium is to be energized, or illuminated, in the "power" column at the lefthand of display 16. One of the twelve power positions, which range from zero to eleven, is fetched (P12). Then, in a manner which is similar in many respects to that of the N10 routine for displaying time, the power position is decremented in four steps (P14), (P18), (P22) and (P26) and corresponding "BORROW" determinations are made (P16), (P20), (P24) and (P28). On the other hand, while that routine successively decrements the fetched power position until the point at which the "borrow" determination becomes a "YES", the various power positions until that determination will not be illuminated, unlike the "time" routine. When a determination is made that a "BORROW" operation was necessary, the corresponding display segment is energized and the appropriate position within that display is energized (P30), (P32), (P34) or (P36). Thereafter the remainder of the positions within the display are zeroed, or blanked (P38). The branch routine may then return to the main routine to begin the DUT SET subroutine (Q10).

Referring to FIG. 6Q, the DUT SET routine (Q10) earlier mentioned is entered and asks for POWER LEVEL (Q12) and a determination is made whether it is 100% power (Q14). If it is full power, the MAG ON flag is set (Q16) and the routine moves to BEG CYC, which controls the magnetron 28 in the appropriate state. If the power level is less than 100%, a routine TIMTST (Q18) is entered and a determination is made if operation is in the TIMER mode (Q20) and if so, the MAG ON flag is turned off (Q22) and the routine moves to BEG CYC. If operation is not in the timer mode at Q20, the routine moves to a DUTY CY routine (Q24) which decrements the units of a count or number (Q26), determines if a borrow is necessary (Q28), if it is then the tens column of the count or number is decremented (Q30) and a determination is made whether it is necessary to borrow (Q32). If borrowing is not necessary at either Q28 or Q32, the routine moves to BEG CYC to continue the appropriate state of magnetron control.

Referring to FIG. 6R as an extension of FIG. 6A and assuming both "borrow" decisions Q28 and Q32 were affirmative, as when a number or count value was zero, a determination (R10) is made whether it is operating as a line cycle counter (as opposed to a duty cycle counter), and if it is, whether the line frequency is 50 Hz (R12). If not, 50 Hz (i.e. 60 Hz), the cycle counter is set to 30 (R14). If it is 50 Hz, the cycle counter is set to 25 (R16). In either event, the timing out of the counter will represent a one-half second interval. At those one-half second intervals, a count representative of the magnetron duty cycle, as a percentage of a 15 second time base, is also decremented in the same manner. When the last digit of the duty cycle count is done (R18), an instruction is issued to alternate the FIRE bit (R20) for use in the magnetron control routine. In this way, the magnetron 28 is fired for the requisite percentage of the 15 second time base, and is off for the remainder.

Figure 6S:
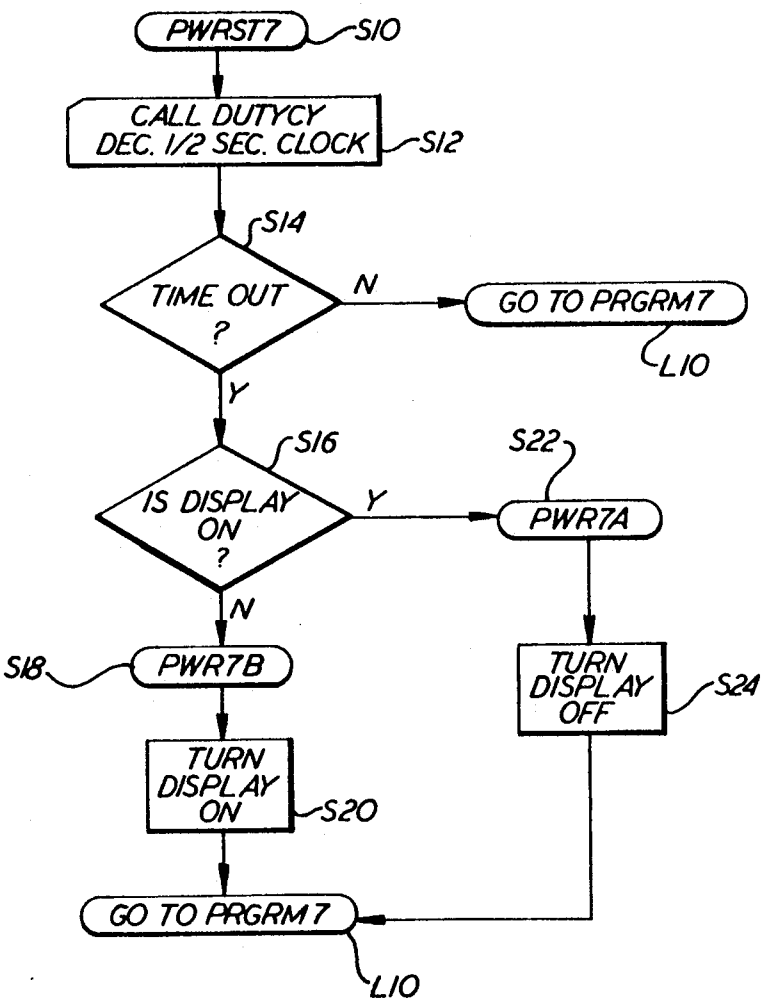

FIG. 6S depicts the PWR ST7 routine from FIG. 6I and includes an instruction to call the DUTY CY routine and to decrement the one-second clock (S12). A determination is made whether the one-half second clock has timed-out (S14) and if it has not, the PRGRM 7 routine (L10) is entered. If the half-second clock of S14 has timed out, it is determined whether the display is ON (S16) and if it is not, a routine PWR 7B (S18) is entered which commands turn on of the display (S20) and then entry to routine PRGRM 7 (L10). If the display had been on at S16, routine PWR 7A is entered (S22) and an instruction is given to turn the display OFF (S24) and then routine PRG RM7 (L10) is entered. This routine effects the alternate flashing ON and OFF of the display.

FIG. 6T depicts the EOC routine (T10) which includes an instruction to activate the R6 output of microcomputer 36 to turn on a sounder (T12), if such is provided; an instruction to initialize the five second power-down timer (T14); an instruction to call for LOOP CY which synchronizes with the line (T16); and an instruction to call CD TIME and to decrement the timer (T18). A determination is made as to whether the five-second timer has timed-out (T20) and if it has, a routine EOC 2 (T22) is entered which turns off the power relay 34 (T24) and effectively shuts down the system. If the five-minute timer had not timed-out at T20, a decision is made whether the CANCEL key 25 has been actuated (T26) and if it has not, a return is made to the loop cycle routine T16. If the CANCEL key has been actuated at T26, the EOC 2 routine at T22 is entered.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to secure by Letters Patent of the United States is:

1. An improved apparatus for the control of a microwave cooking appliance having a microwave power circuit including a microwave generator, a source of electrical power for at least said microwave power circuit, and control means for controlling at least the microwave power circuit, the improvement wherein said control means comprises:

an electrically-energized electronic controller for operating in accordance with data programmed therein, said electronic controller being operatively connected to said microwave power circuit for controlling application of said electrical power to said microwave power circuit; and input control circuit means connected to said electrical power source and to said electronic controller for controlling application of electrical energizing power to and entry of programming data into, said electronic controller, said input control circuit means including at least a data entry key for controlling the programming of data into said electronic controller, said input control circuit means being further operative in response to an initial actuation of said data entry key for applying start-up energizing power to said electronic controller.

2. The apparatus of claim 1 wherein said input control circuit means includes a preliminary supply circuit and a main supply circuit each connected between said source of electrical power and said electronic controller, said preliminary supply circuit being made conductive by said initial actuation of said data entry key and said main supply circuit being made conductive only following said completion of said preliminary supply circuit.

3. The apparatus of claim 2 wherein said main supply circuit includes a normally-open, signal-responsive power switch in series therewith, said power switch being actuated to its closed position by a latching signal from said electronic controller, said electronic controller being responsive to said initial actuation of said data entry key for providing said latching signal.

4. The apparatus of claim 3 wherein said signal-responsive switch in said main supply circuit comprises a power relay having a pair of normally-open contacts, said contacts being closed while said relay receives said latching signal.

5. The apparatus of claim 4 wherein said power relay includes a second pair of normally-open contacts, said microwave power circuit including said second pair of normally-open contacts in series therewith, whereby said microwave generator is capable of receiving electrical power from said source only while said power relay receives said latching signal.

6. The apparatus of claim 3 wherein said preliminary supply circuit includes a normally-open, power-up switch in series therewith, said input control circuit means including a manually-actuatable data entry switch operatively connected to said electronic controller for controlling the programming of data thereinto when actuated and wherein said data entry key, said power-up switch and said data entry switch are so structured and positioned that actuation of said data entry key is operative both to close said power-up switch and to actuate said data entry switch.

7. The apparatus of claim 6 wherein said input control circuit means further includes a plurality of said data entry keys and a corresponding plurality of both said data entry switches and said power-up switches, whereby the initial actuation of any one of said plurality of said data entry keys is operative to apply start-up energizing power to said electronic controller.

8. The apparatus of claim 7 wherein said electronic controller is responsive to data received for providing timing and power level control functions and wherein each of said plurality of data entry keys is operative, when actuated, to enter said data into said electronic controller.

9. The apparatus of claim 8 wherein said latching signal from said electronic controller is terminated upon completion of a timing function thereby to open said main supply circuit and remove energizing power from said electronic controller.

10. The apparatus of claim 7 wherein said electronic controller includes a pre-stored program which is responsive to said initial actuation of one of said data entry keys for starting a power-down timer which is preset to a predetermined interval representing the maximum allowable interval before next actuation of any one of said data entry keys, said latching signal to said power switch being terminated to remove energizing power from said electronic controller if said power-down timer times out prior to any said next actuation of one of said data entry keys.

11. The apparatus of claim 10 wherein said predetermined interval of said power-down timer is about 10 seconds.

12. The apparatus of claim 7 wherein said electronic controller is responsive to the entry of data via the selective actuation of said data entry keys for defining an operating program therein;

said input control circuit means further includes at least one function key operatively connected to said electronic controller and being actuatable for initiating the execution of said operating program; and wherein said electronic controller further includes power-down timing means which is preset to a predetermined timing interval, is started by the actuation of any one of said data entry keys and which times out only if neither one of said data entry keys nor said function key is actuated during said predetermined timing interval, and wherein said timing out of said power-down timing means is operative to terminate said latching signal to said power switch thereby to remove energizing power from said electronic controller.

* * * * *